US010997957B2

(12) United States Patent
Starr

(10) Patent No.: US 10,997,957 B2
(45) **Date of Patent: *May 4, 2021**

(54) ELECTRONIC MUSICAL INSTRUMENT WITH DEVICE

(71) Applicant: Harvey Starr, San Diego, CA (US)

(72) Inventor: Harvey Starr, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/848,371

(22) Filed: Apr. 14, 2020

(65) Prior Publication Data

US 2020/0273439 A1 Aug. 27, 2020

Related U.S. Application Data

(63) Continuation-in-part of application No. 16/241,901, filed on Jan. 7, 2019, now Pat. No. 10,621,963.

(60) Provisional application No. 62/636,407, filed on Feb. 28, 2018, provisional application No. 62/613,983, filed on Jan. 5, 2018.

(51) Int. Cl.
*G10H 1/00* (2006.01)
*G10H 1/34* (2006.01)

(52) U.S. Cl.
CPC ..... *G10H 1/0008* (2013.01); *G10H 1/342* (2013.01); *G10H 2220/096* (2013.01); *G10H 2220/221* (2013.01)

(58) Field of Classification Search
CPC ..... G10H 1/0008; G10H 1/342; G10H 1/344; G10H 2220/221
See application file for complete search history.

(56) References Cited

U.S. PATENT DOCUMENTS 8,796,529 B2 * 8/2014 Butera ..... G10H 1/342 84/722
8,975,501 B2 * 3/2015 Roebke ..... G10D 3/06 84/615
9,117,431 B1 * 8/2015 Rudes ..... G10H 1/32
2011/0283868 A1 * 11/2011 Behringer ..... G10H 1/0008 84/622
2012/0297962 A1 * 11/2012 O'Donnell ..... G10H 1/34 84/645
2012/0318121 A1 * 12/2012 Mittelstadt ..... G10H 1/342 84/743
2013/0068086 A1 * 3/2013 Mittelstadt ..... G09B 15/003 84/645
2013/0174717 A1 * 7/2013 Butera ..... G10H 1/342 84/609

(Continued)

*Primary Examiner* — Jeffrey Donels
(74) *Attorney, Agent, or Firm* — Lewis Kohn & Walker LLP; Kent M. Walker; Kari Moyer-Henry

(57) ABSTRACT

The invention pertains to devices utilized by artists that produce musical sounds and aesthetic lights, including lights that correspond to the sounds. More specifically, the invention pertains to a modular system comprising modules of a play device, such as a smart phone, a fingerboard comprising a keyboard and lights corresponding to the keys and a docking station for mounting and joining the play device and fingerboard together. Using music and light control application software loaded on the play device and the keys of the fingerboard, the play device and fingerboard exchange and communicate sound and light information and instructions with each other. The play device plays sounds and the fingerboard displays lights.

29 Claims, 45 Drawing Sheets

(56) References Cited

U.S. PATENT DOCUMENTS

2016/0163298 A1* 6/2016 Butera ..... G10H 1/342
84/615

* cited by examiner

FIG. 14
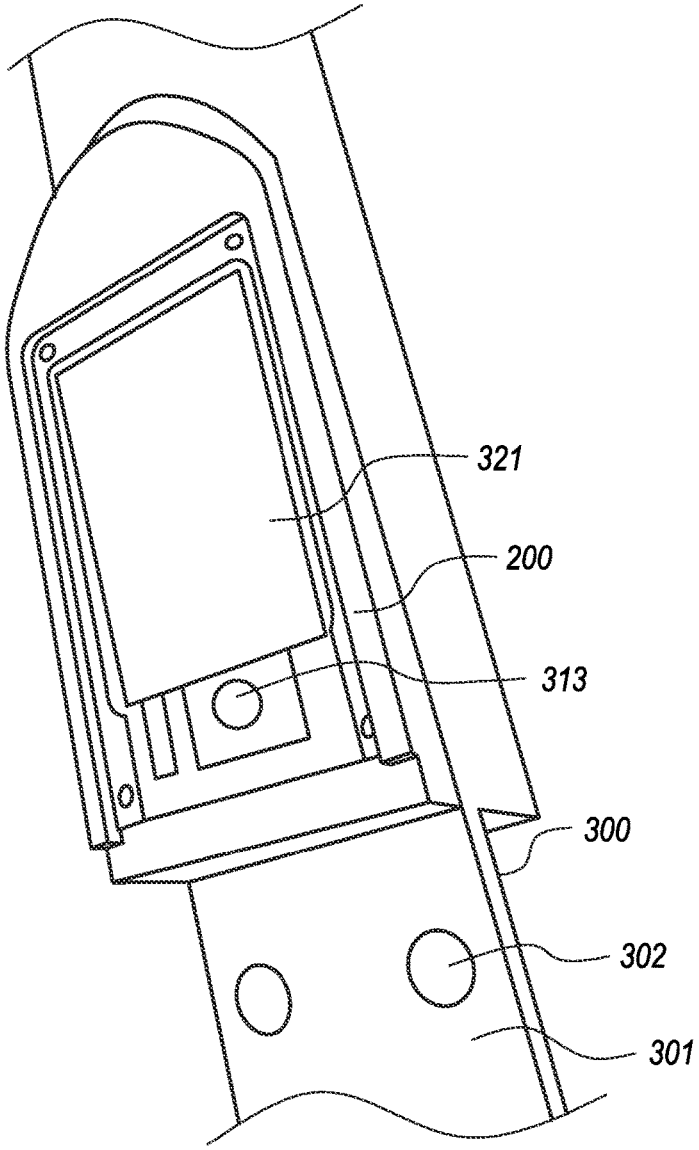
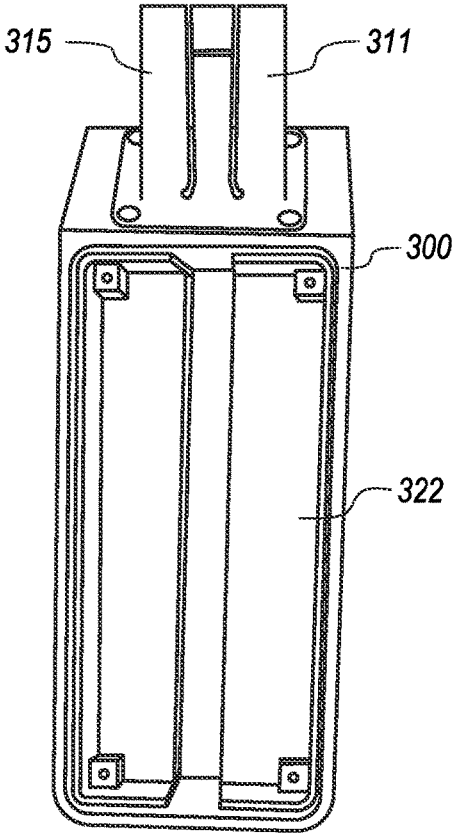
FIG. 15

ELECTRONIC MUSICAL INSTRUMENT WITH DEVICE

CROSS REFERENCE TO RELATED APPLICATIONS

This application is a Continuation-In-Part patent application claiming the benefit of priority from application Ser. No. 16/241,901, filed Jan. 7, 2019, now U.S. Pat. No. 10,621,983, which claims the benefit of priority from Provisional Application Ser. No. 62/613,983 filed Jan. 5, 2018, and Provisional Application Ser. No. 62/636,407 filed Feb. 28, 2018, the contents of which are incorporated by reference herein.

BACKGROUND OF THE INVENTION

Field of the Invention

The present invention pertains generally to devices utilized by artists that produce musical sound. More specifically, a preferred embodiment relates to an electronic fingerboard instrument coupled to a touch screen with both devices interfacing with a docking apparatus.

Description of the Prior Art

For many decades electronic music devices have been known in the art for the multitude of sounds that can be produced by a single instrument. Also known are electronic fingerboards having an elongated neck portion attempting to simulate operation of an acoustic guitar. These are sometimes referred to as synthetic guitars or stringless guitars; and, a useful example was proposed by present inventor, Starr, U.S. Pat. No. 5,398,585 entitled "Fingerboard for Musical Instrument." In this example somewhat advanced for its time, pressure responsive circuits are coupled to a programmable microprocessor.

More advancement has led to a commercial tablet computer being configured to a fingerboard-type imitation guitar. Namely, a musical device has been provided by Behringer et al., U.S. Pat. No. 8,093,486 entitled "Touch Screen Guitar." According to Behringer and his co-inventor, partial motivation for coupling a fingerboard to an iPad (brand tablet) is to reduce production costs due to simplifying circuitry. For this and other reasons, the device disclosed in the '486 patent is more suitable to the general enthusiast such as those who enjoy the Guitar Hero, brand video game.

The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 14 shows back perspective view of dock 300 and fingerboard 200 including battery pack power source 321 in battery cavity power storage space 322 in one embodiment of present invention;

FIG. 15 shows a back plan view of dock 300 and alternative power storage space 322 for battery pack 321 in another embodiment of present invention;

INVENTION DESCRIPTION

Figure 1:
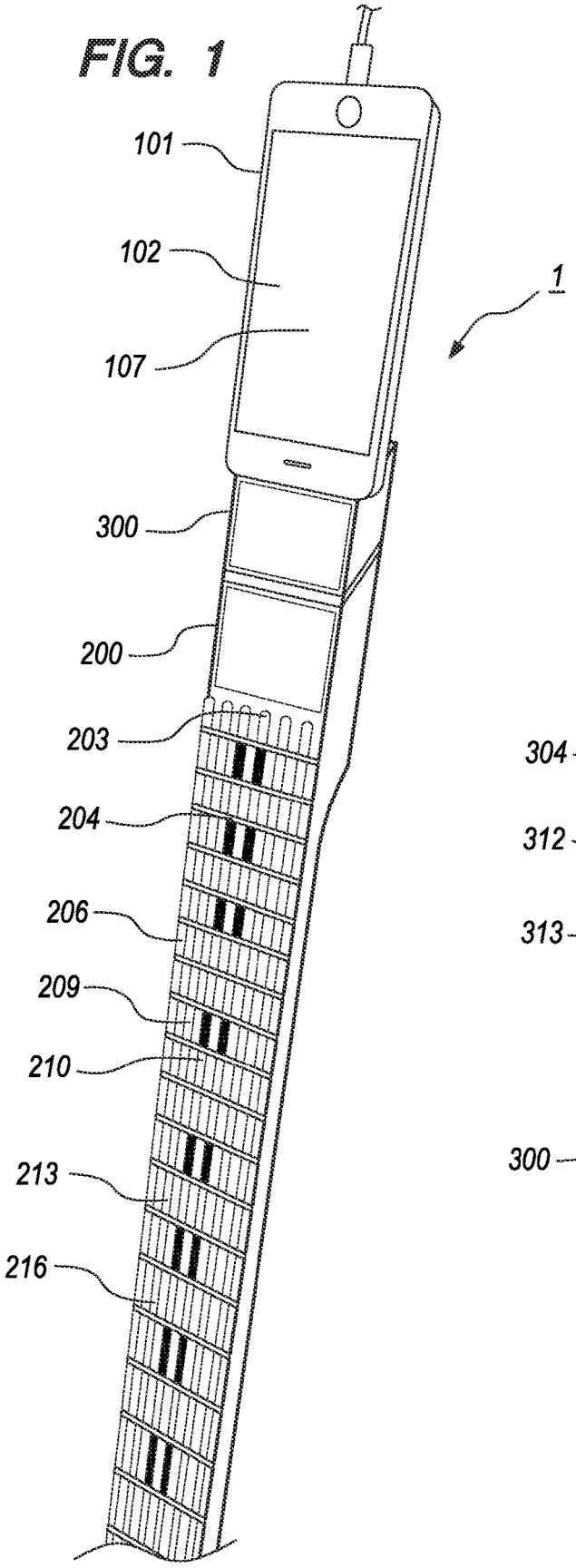
FIG. 1 shows front perspective view of a fingerboard 200 and dock 300 with wireless phone play device 101 inserted of the present invention.

FIGS. 60 to 63, 1 to 25 and 36 to 55 are directed to a preferred embodiment wherein a fingerboard 200 and dock 300 are configured for compatibility with a play device 100, such as a wireless play device 101, such as a wireless phone.

FIGS. 26 to 31 and 56 to 59 are directed to an alternative embodiment wherein a fingerboard 200 and dock 300 are configured for compatibility with a string box 110 device.

Figure 32:
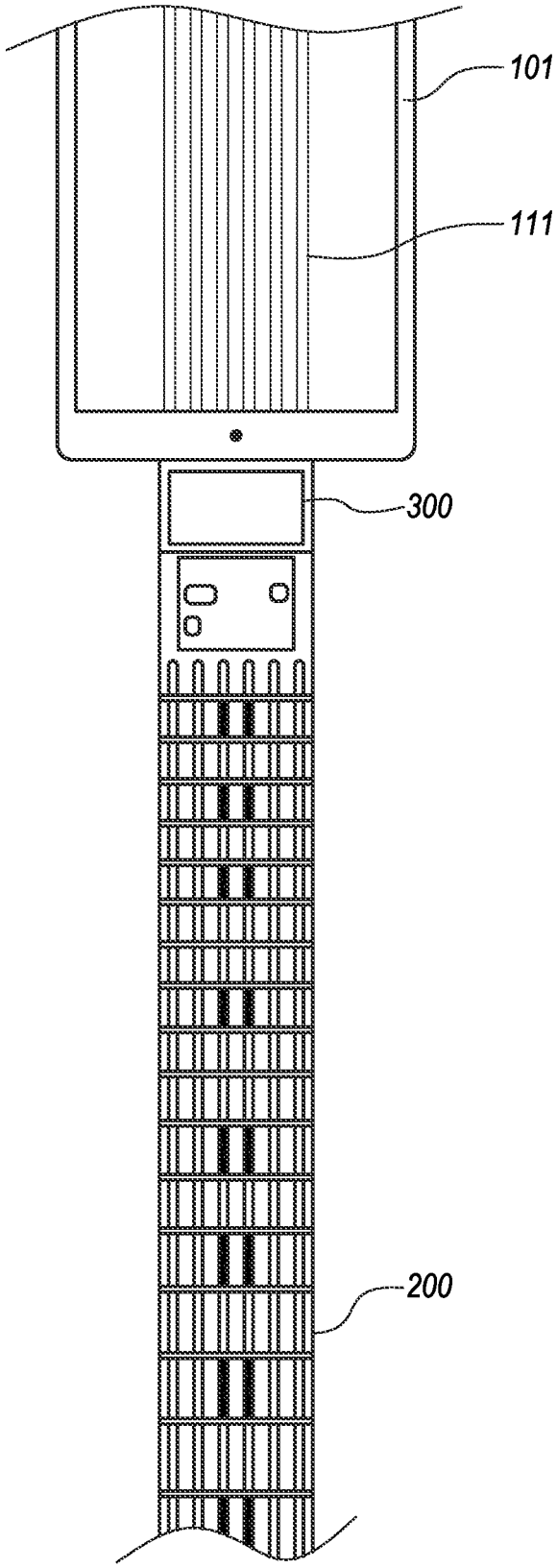
FIG. 32 shows front perspective view of fingerboard 200 and dock 300 with wireless tablet inserted of the present invention.
Figure 33:
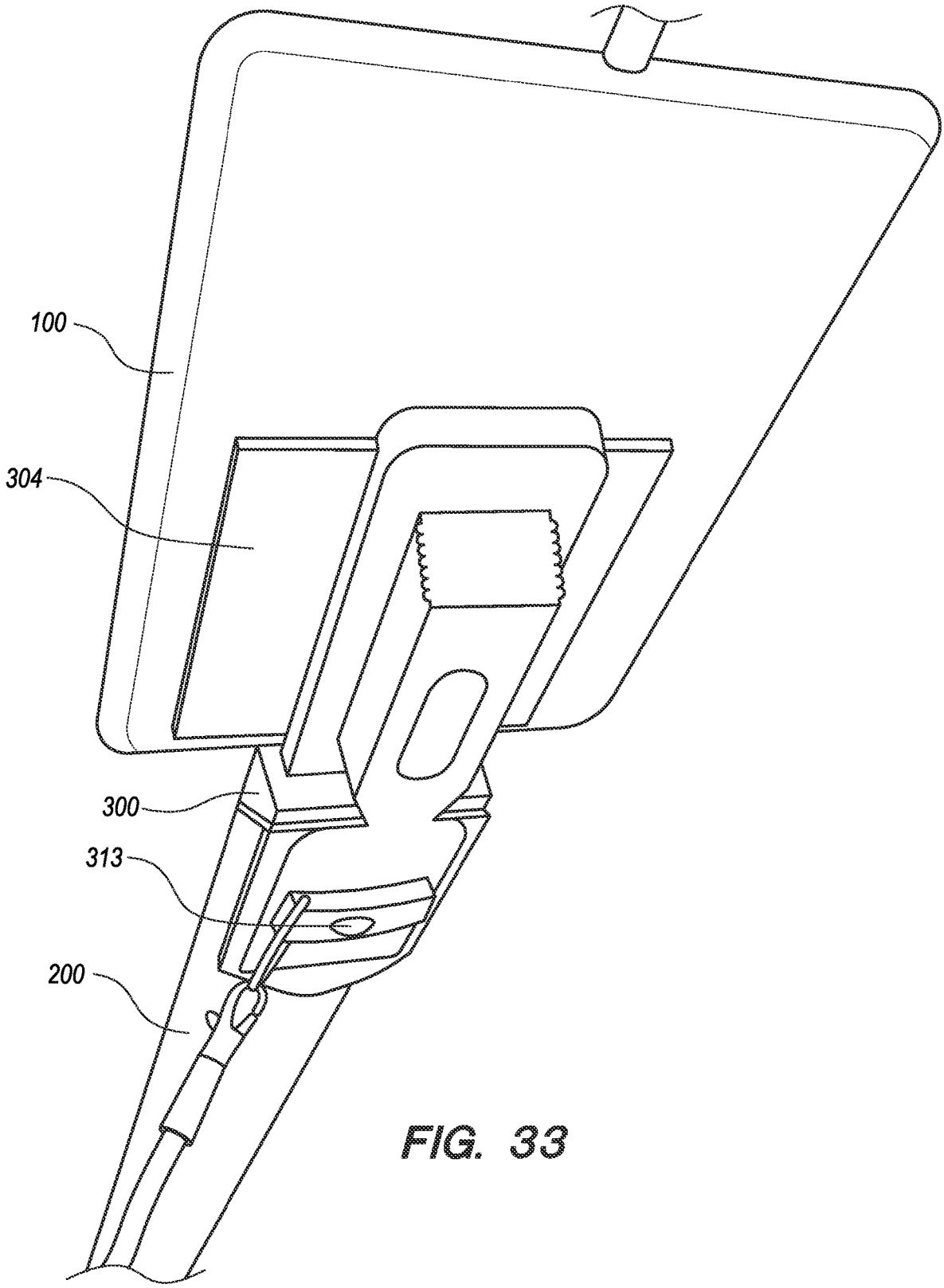
FIG. 33 shows rear perspective view of a dock 300 with wireless tablet 100 inserted of the present invention.
Figure 34:
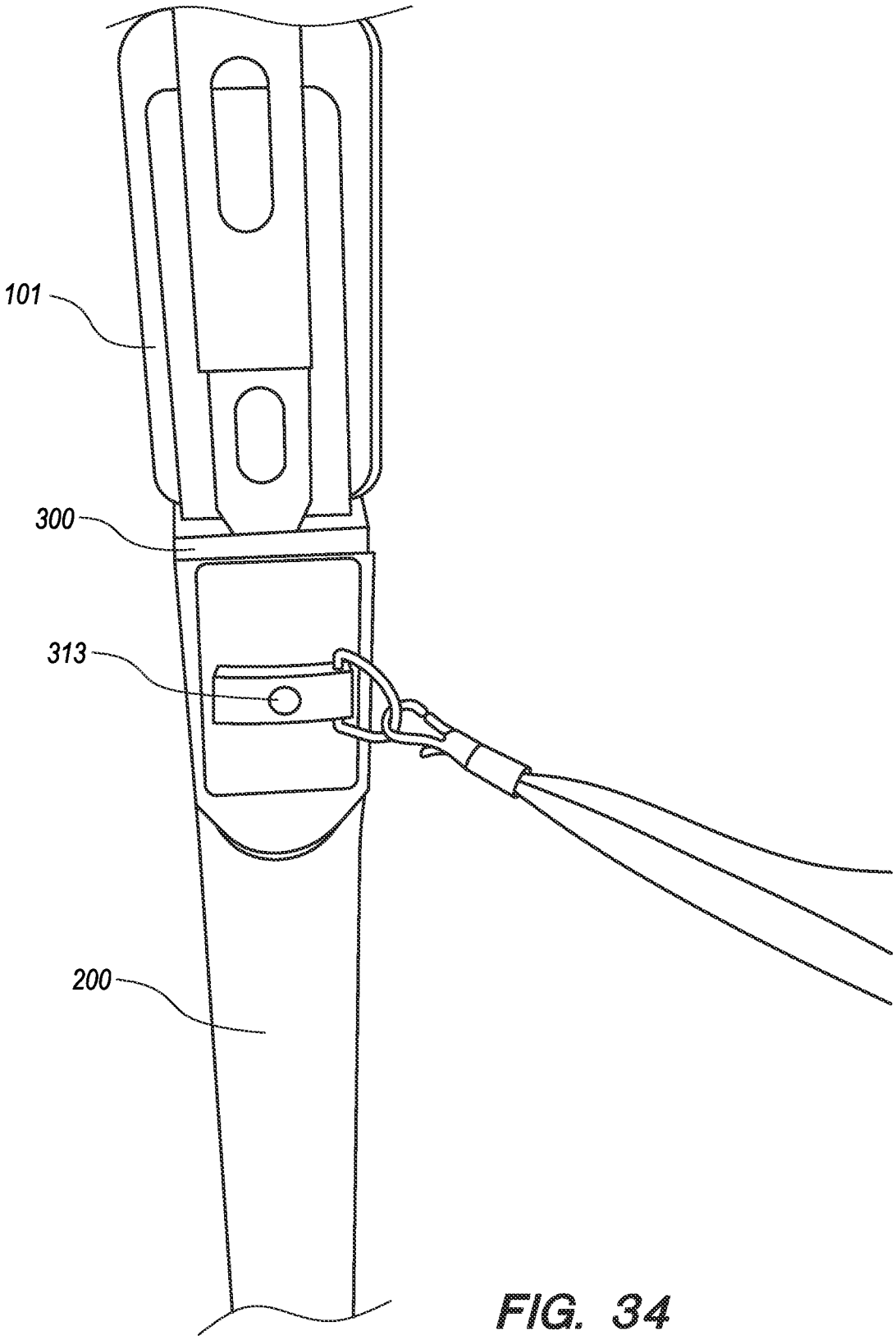
FIG. 34 shows rear perspective view of a dock 300 and fingerboard 200 without wireless tablet inserted of the present invention.

FIGS. 32 to 34 are directed to an alternative embodiment wherein a fingerboard 200 and dock 300 are configured for compatibility with a wireless play device 101, such as a tablet device.

Figure 35:
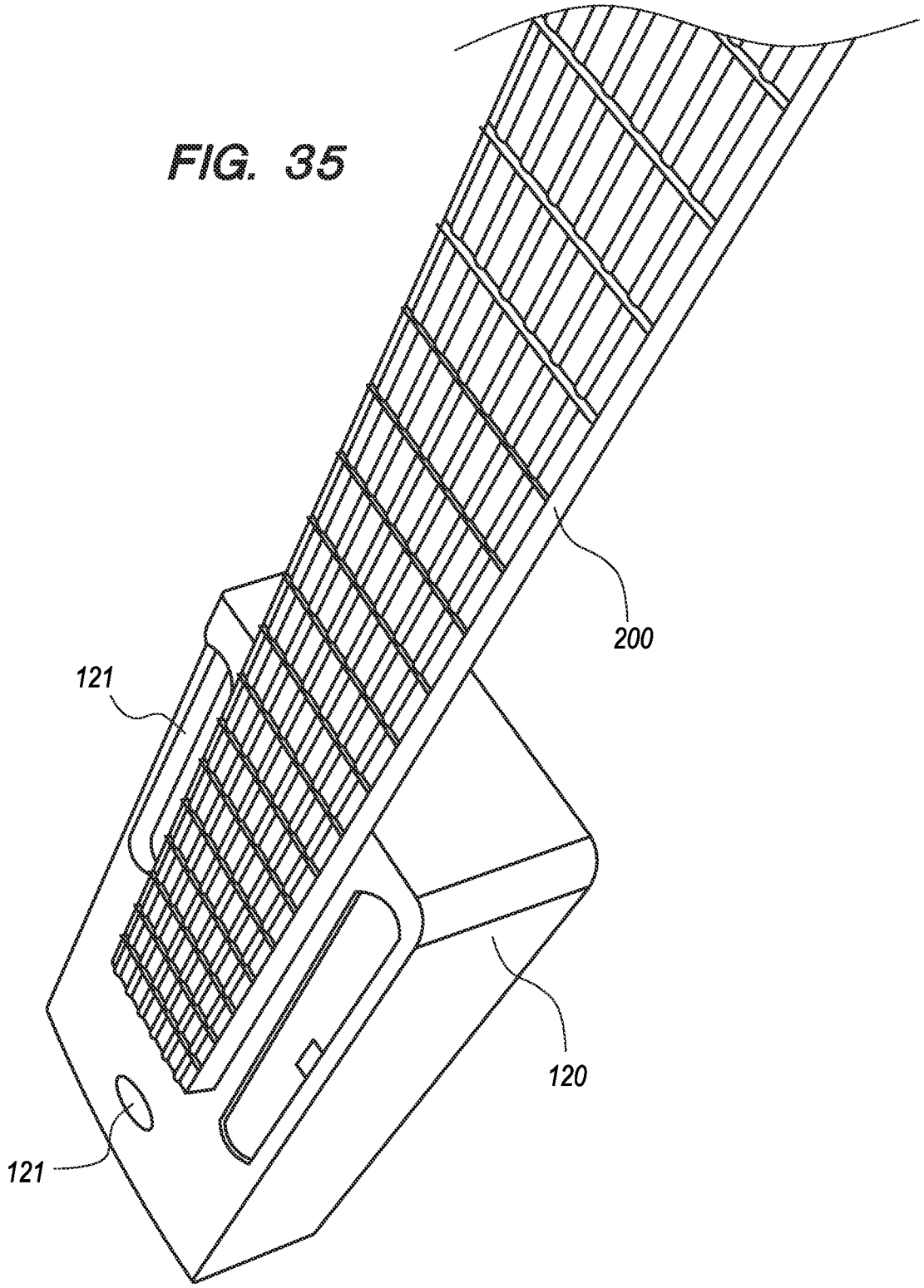
FIG. 35 shows front perspective view of a dock 300 with a hardware box 120 inserted of the present invention.
Figure 36:
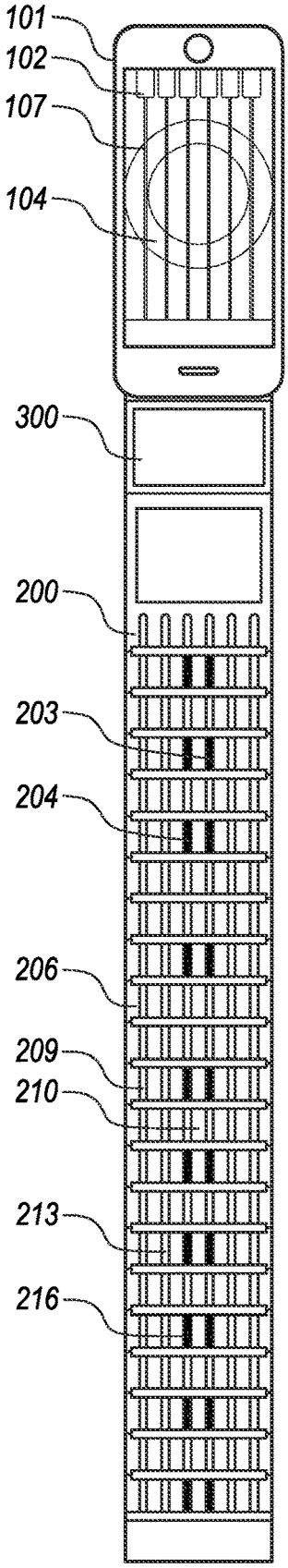
FIG. 36 shows front perspective view of a fingerboard 200 and dock 300 with wireless phone 101 inserted of the present invention.

FIG. 35 is directed to an alternative embodiment wherein a fingerboard 200 and dock 300 are configured for compatibility with a hardware box play device 120.

FIGS. 64 to 70 are directed to an alternative embodiment wherein a fingerboard 200 and dock 300 are joined as a unitary device absent a joinder mechanism 311 and wherein the attachment of the play device 100 to the dock 300 is further accomplished with deepened recesses 303 in the dock and magnets 302 on the plate 304 which are received in the recesses.

Figure 63:
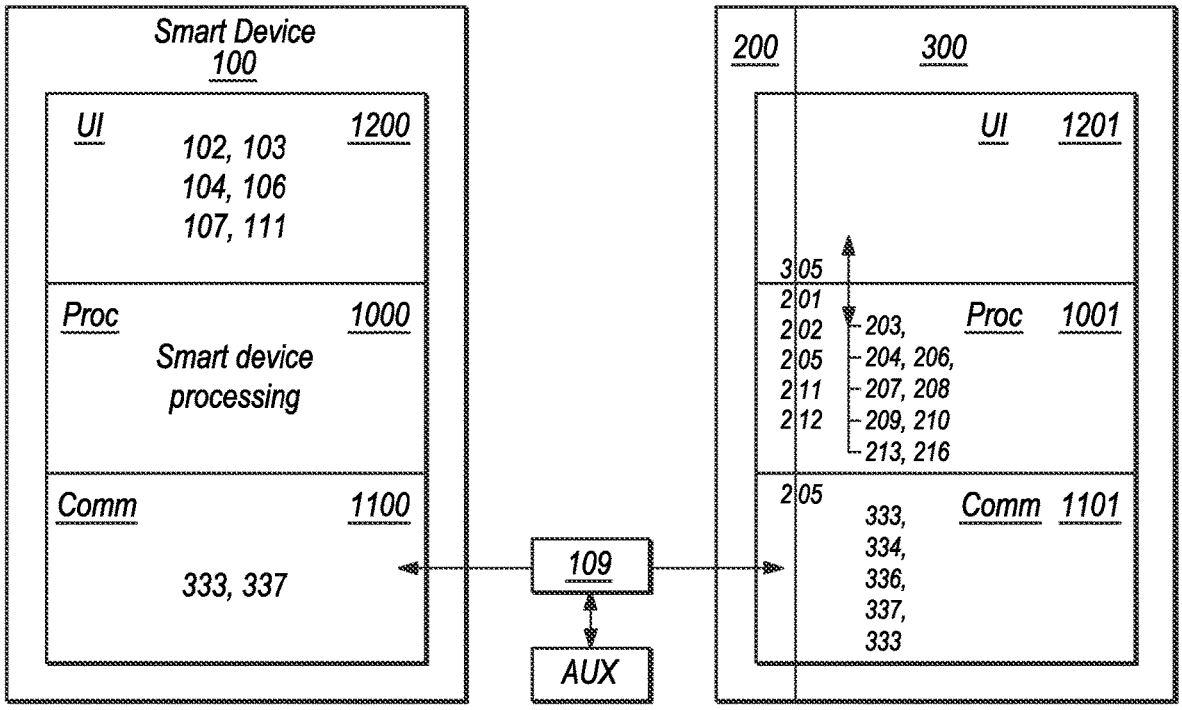
FIG. 63 shows a block diagram of the dock 300, fingerboard 200 and play device 100 and their corresponding user interfaces 1100 and 1101, processing 1000 and 1001 and communications 1200 and 1201 in one embodiment of the present invention.

FIG. 63 is directed to an overview of the fingerboard 200 and dock 300 and their corresponding user interfaces 1100 and 1101, processing 1000 and 1001 and communications 1200 and 1201 of the dock 300, fingerboard 200 and play device 100.

As such, as shown in FIGS. 60, 61, 62, 1, 36 and 37, the present invention provides a modular system 1, including primarily the dock 300, fingerboard 200 and play device 100. As such and as described below and shown in the Figures, the modular components can be assembled and disassembled both mechanically and electronically. And, as such, the invention and modular components are compatible with numerous variations, including significantly for examples, alternative smart and wireless play devices 101, such as phones and tablets, as well as specialized components such as the string box 110 and hardware box 120.

With reference to FIGS. 60, 61, 1 and 36, shown is a preferred fingerboard 200 and dock 300 configured for compatibility and joined with a smart device 101, specifically any commercially available wireless phone and by way of example, an Apple brand of phone. The dock 300 and fingerboard may be made from any suitable material that is lightweight, sturdy and amenable to formation into particular shapes. This includes without limitation metal, metal coated, wood, plastic and composite parts and components. The dock 300 physically couples the phone to the specifically designed fingerboard 200 of the present invention (as best seen in FIGS. 101, 102, 103, 1, 3, 5, 8, 36, 37 and 39). As shown in FIGS. 60, 1, 3, 5, 8, 36, 37 and 39 preferably, magnets 302 are included in openings (spaces, cavities) 303 in the phone docking surface 301 of the dock 300 and a plate 304 (e.g., steel or otherwise magnetic plate) or one or more magnets 302 or steel parts 304 are also attached to the back surface of the phone 101 to physically couple of the phone 101 to the dock 300. Preferably, the phone 101 and fingerboard 200 are digitally connected and communicate via wireless communication hardware in the dock 300 and/or fingerboard 200 (e.g., see circuit board 201 and Bluetooth modulator chip 205 of the fingerboard 200 and/or dock 300 in FIGS. 60, 24, 25, 44, 46 and 47) and Bluetooth and other wireless communication hardware in or otherwise used by the phone. Preferably, low latency arrangements are used. Alternatively, the phone 101 may be digitally coupled to the fingerboard 200 via data connectors of the phone 101 connected to data connectors 333, 334 of the dock 300 and/or fingerboard 200 (see FIGS. 18, 19 and 23 (top data connector 333 is USB compatible (334) and bottom connector is HDMI compatible)). As further shown in FIGS. 60, 37 and 39, the fingerboard 200 and/or dock 300 (also the Smartphone display 102 itself) can include a user interface 207 for display of operational conditions, status and features of the invention, such as status of communication mode (e.g., Bluetooth), training mode, and edit modes 208.

With reference to FIGS. 26 to 31, shown is an alternative embodiment comprising the fingerboard 200 and dock 300 configured for compatibility and joined with a specifically designed string box play device 110, which as shown can have strings 111 resembling the strings of a guitar and circuitry 112 and a data connector 333 to couple and communicate with the dock 300 and fingerboard 200. Preferably, the string box play device 110 is digitally coupled to the fingerboard 200 via data connectors 333 and cable 332 of the stringbox 110 connected to data connectors 333 of the dock 300 (see FIGS. 30 and 31 (using HDMI)) and/or fingerboard 200.

With reference to FIGS. 64 to 68, shown is an alternative embodiment comprising the fingerboard 200 and dock 300 joined as a unitary device absent a joinder mechanism 311. In other words, no joinder mechanism 311 is used to selectively mount and dismount the fingerboard 200 and dock 300 with respect to each other. Instead, fingerboard 200 and dock 300 are joined together by any variety of means to provide a unitary device that does not separate at the intersection of the fingerboard 200 and dock 300. All other hardware and software combinations described in other embodiments may otherwise be included in this embodiment. As shown, this provides different utility and aesthetics to the device, such as more streamlined shapes and surfaces and avoidance of breakable joinders and connections, a unitary device rather than multiple component device.

As described above and further below, the basic functional assembly and system 1 of the invention is comprised of the electronic guitar neck (fingerboard 200), docking station (300) and the companion mobile device, a "smartphone" or tablet 100. Musical notes may be created from this system 1 in several ways. In its simplest operation, playing keys 209 on the fingerboard 200 will directly elicit musical notes from the smartphone 101. In another type of performance, the touch surface 107 of the phone is used to create notes selected on the fingerboard 200.

For people accustomed to playing guitar, it is a desire to use their customary strumming and picking techniques with hardware that resembles a real guitar rather that a flat glass touchscreen. The string box controller 110 shown in FIGS. 26 to 31 and 56 to 59 addresses this desire. The string box accessory 110 is a bank of guitar strings 111 fastened into a frame and/or the dock 300 that is able to insert into the into the fingerboard 200 and/or dock 300 in similar fashion as does the dock 300 that can also carry the smart device 101, thereby creating a unitary guitar-like instrument system 1 with the strings 111 attached to the fingerboard 200.

With reference to FIGS. 32 to 34, shown is another alternative embodiment comprising the fingerboard 200 and dock 300 configured for compatibility and joined with any commercially available tablet device 101, including by example an Apple tablet as shown. As with the phone embodiment, the tablet 101 and dock 300 preferably include magnets 302 that secure the tablet to the dock 300 (see FIGS. 5, 8 and 33). Also, as with the phone embodiment, the tablet 101 may alternatively be digitally coupled to the fingerboard 200 via data connectors 333 and cable 332 of the tablet 101 connected to data connectors 333 and cables 332 of the dock 300 and fingerboard 200.

Alternatively, the dock 300 may be comprised of several bracket components for securing the phone, tablet or other smart device 101 to the dock 300. The bracket components may be made from any suitable material that is lightweight, sturdy, amenable to formation into particular shapes, and to the use of connectors therewith and to drilling of connection holes therein.

With reference to FIGS. 52 to 55, the phone device 101 may use one or more software applications 104, e.g., iTar App, which may run on a phone, tablet or other smart device 101 mounted on the dock 300 and utilize the touchscreen 107 of the device 101 to simulate guitar strings 111 or other instruments which may be strummed or otherwise activated to trigger the notes that are fingered on the attached fingerboard 200. As described below, the applications may provide numerous other features.

Figure 2:
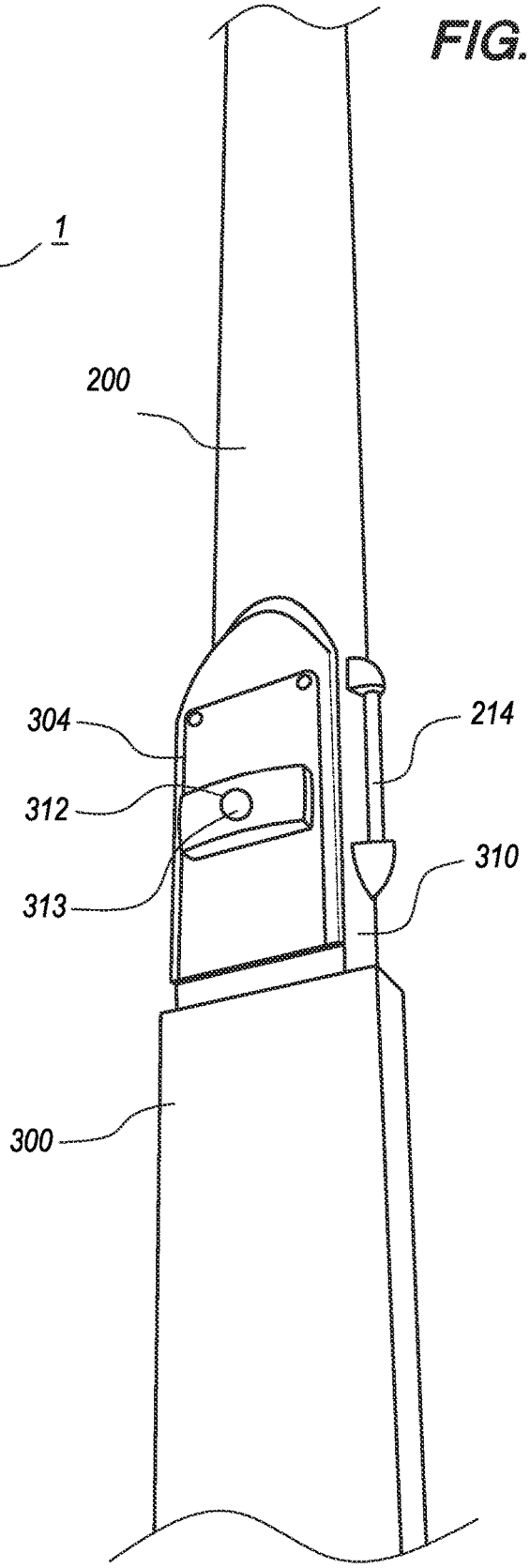
FIG. 2 shows a rear plan view of a fingerboard 200 and dock 300 with wireless phone 101 inserted of the present invention.
Figure 61:
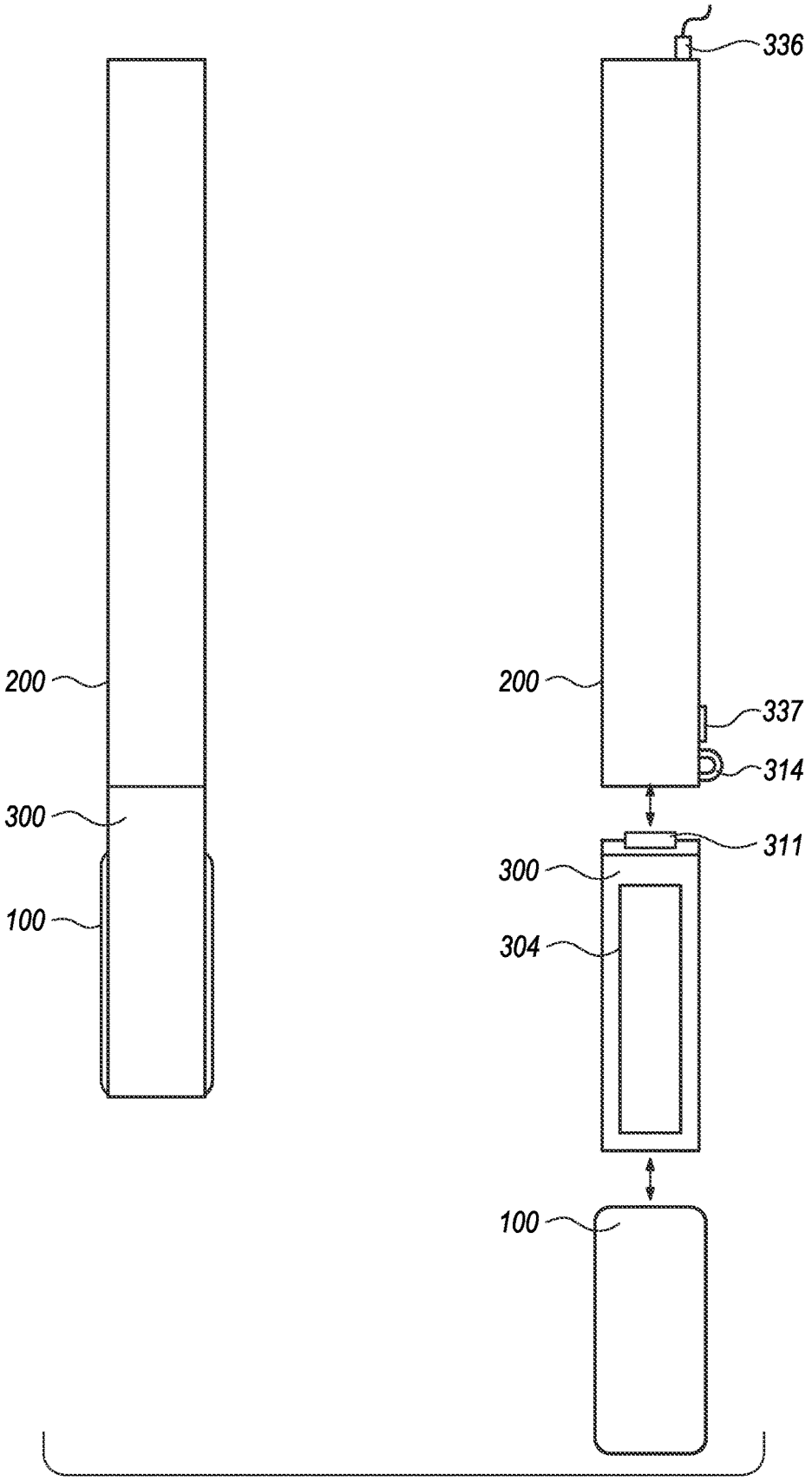
FIG. 61 shows a back plan view of the dock 300, fingerboard 200 and wireless play device 100 in one embodiment of the present invention.

With reference to FIGS. 61 and 2, shown is the back view of the preferred dock 300 arrangement of FIG. 1. The back of the dock 300 is flat and plain in this embodiment. The back of the fingerboard 200 near the dock 300 includes a cover plate 304 secured to the dock 300 and placed over a cavity 322 for housing a battery 321 for powering the circuitry 201 of the fingerboard 200 and/or the phone, tablet 101 and/or boxes 110 or 120. As also shown, a button or knob 312 protrudes above the plate from the fingerboard 200 to provide a mechanism 312 to selectively release joining and/or locking mechanisms 315 of the joinder mechanisms 311 of dock 300 and fingerboard 200. As also shown, the sides of the fingerboard 200 include mounts or mounting brackets 214 for attachment to external devices, such as guitar straps.

Figure 37:
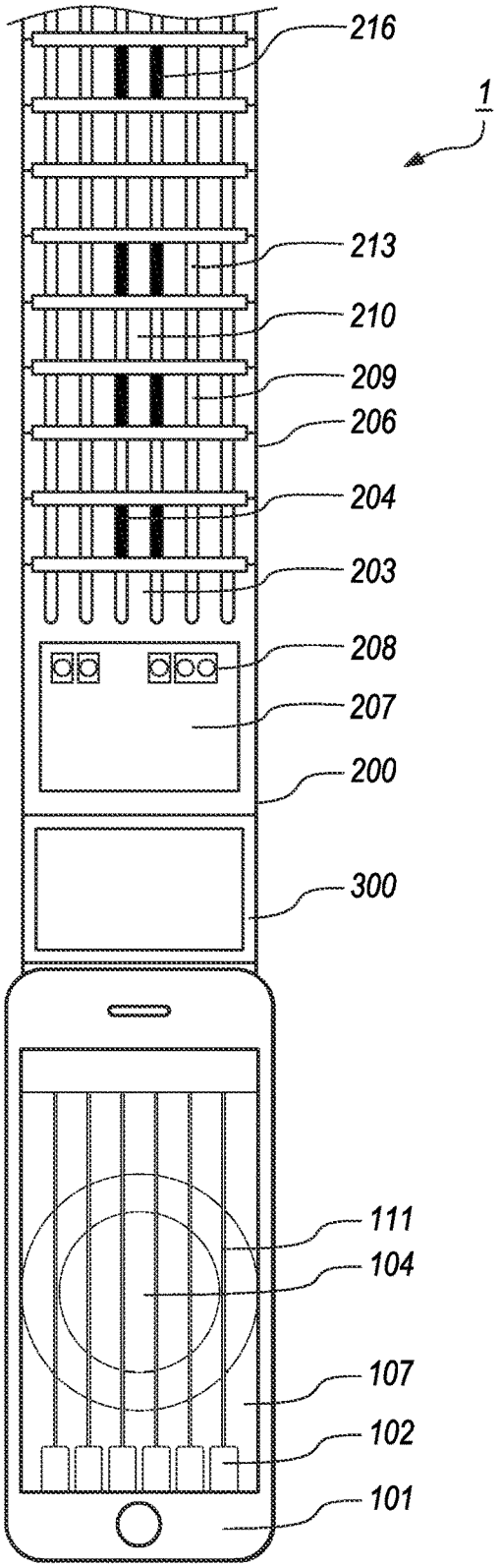
FIG. 37 shows a front plan view of a fingerboard 200 and dock 300 with wireless phone 101 inserted of the present invention.
Figure 41:
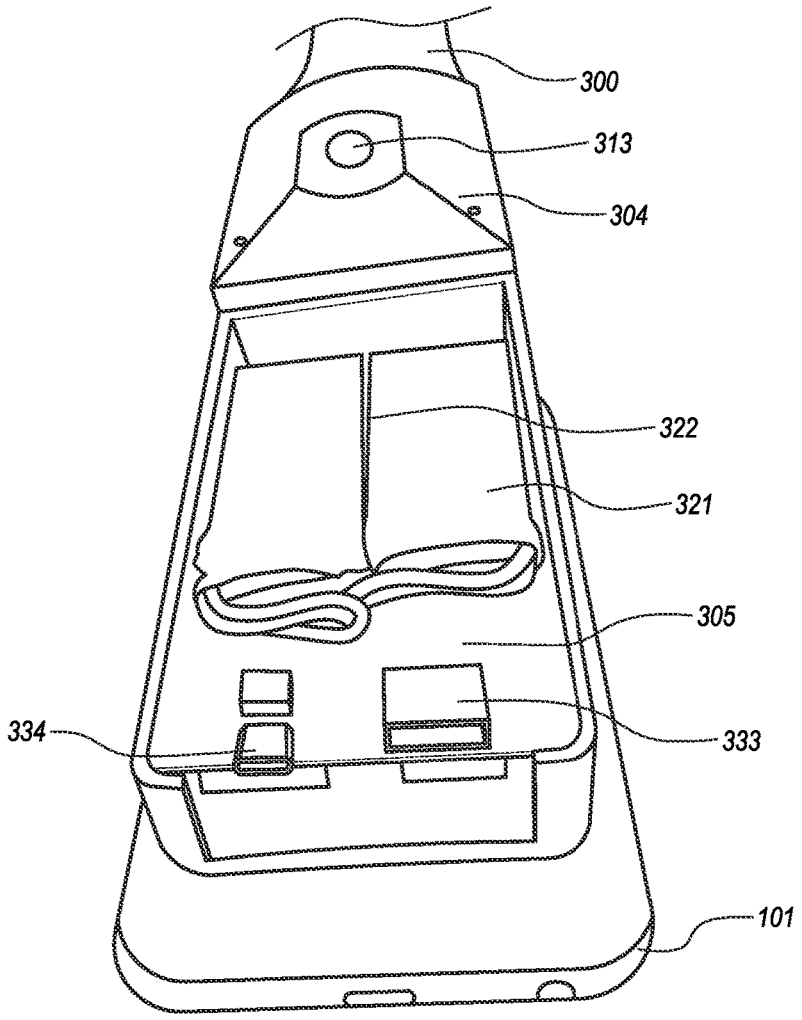
FIG. 41 shows back perspective view of dock 300 including battery pack 321 in battery cavity 322 in one embodiment of present invention.
Figure 42:
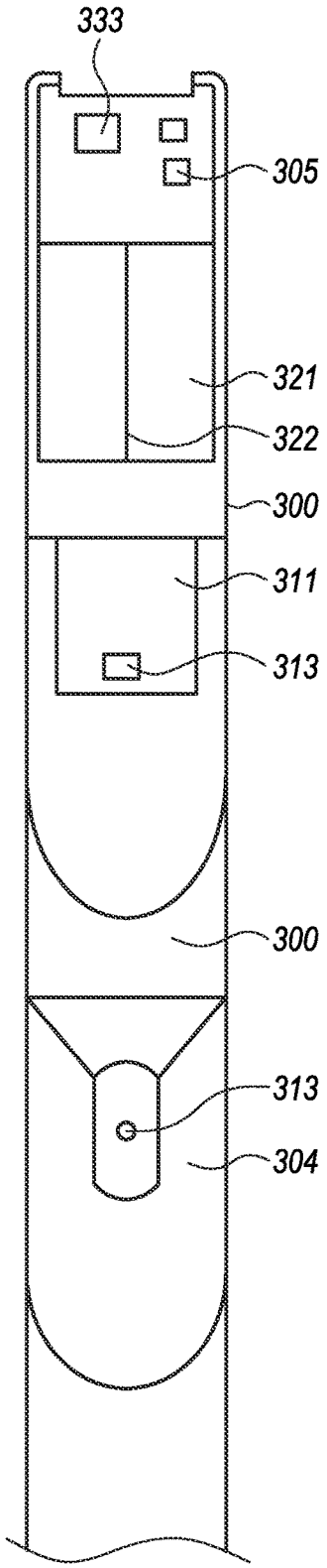
FIG. 42 shows back perspective view of dock 300 including battery pack 321 in battery cavity 322 in one embodiment of present invention.

Alternatively, with reference to FIGS. 62, 40 to 42, shown are back views of the preferred dock 300 arrangement of FIG. 37. Here, in this embodiment, as opposed to the fingerboard 200, the dock 300 includes a compartment to house circuitry 305 and power sources 321 (e.g., battery pack). The back of the fingerboard 200 near the dock 300 includes a cover plate 304 that can be secured to the dock 300. As shown, a button or knob 312 can protrude above the plate from the fingerboard 200 to provide a mechanism 312 to selectively release locking mechanisms 315 of the joinder mechanism 311 between the dock 300 and fingerboard 200. As also shown in FIG. 41, the end of the dock 300 includes USB and other connectors 333, 334, 324 for connecting to power sources and connecting to and communicating with ancillary devices, such as other communication devices and equipment (e.g. 100).

Figure 3:
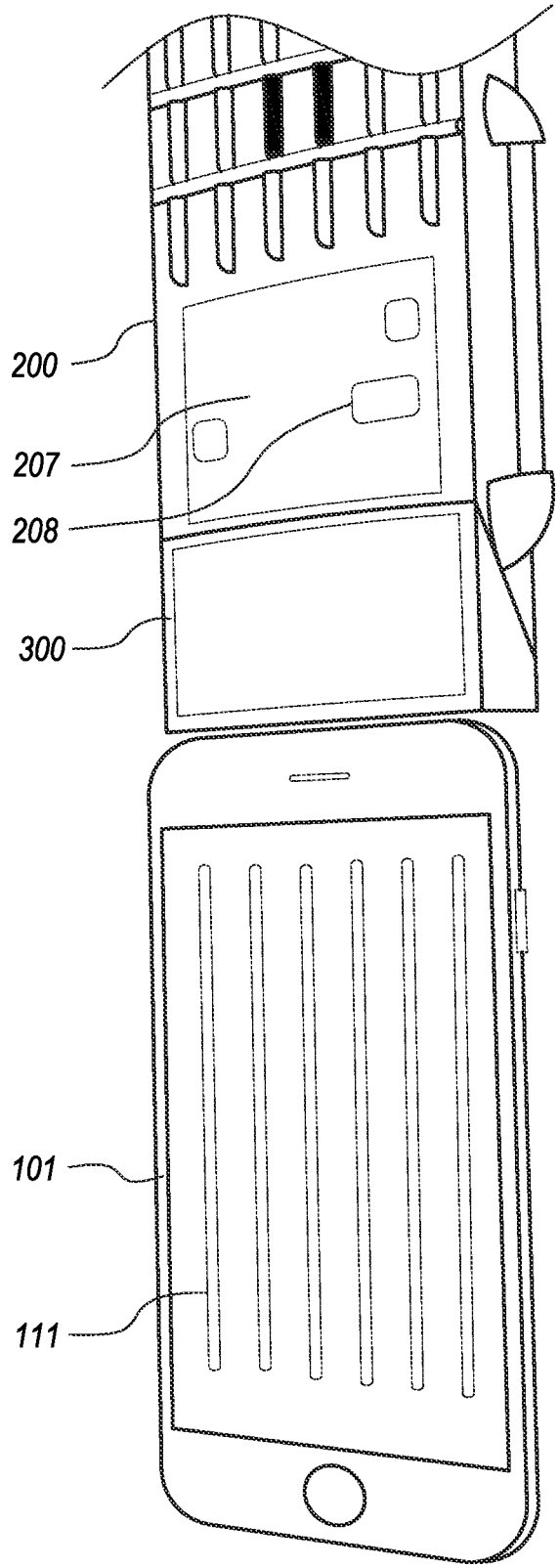
FIG. 3 shows a front plan view of a dock 300 with wireless phone 101 inserted of the present invention.
Figure 60:
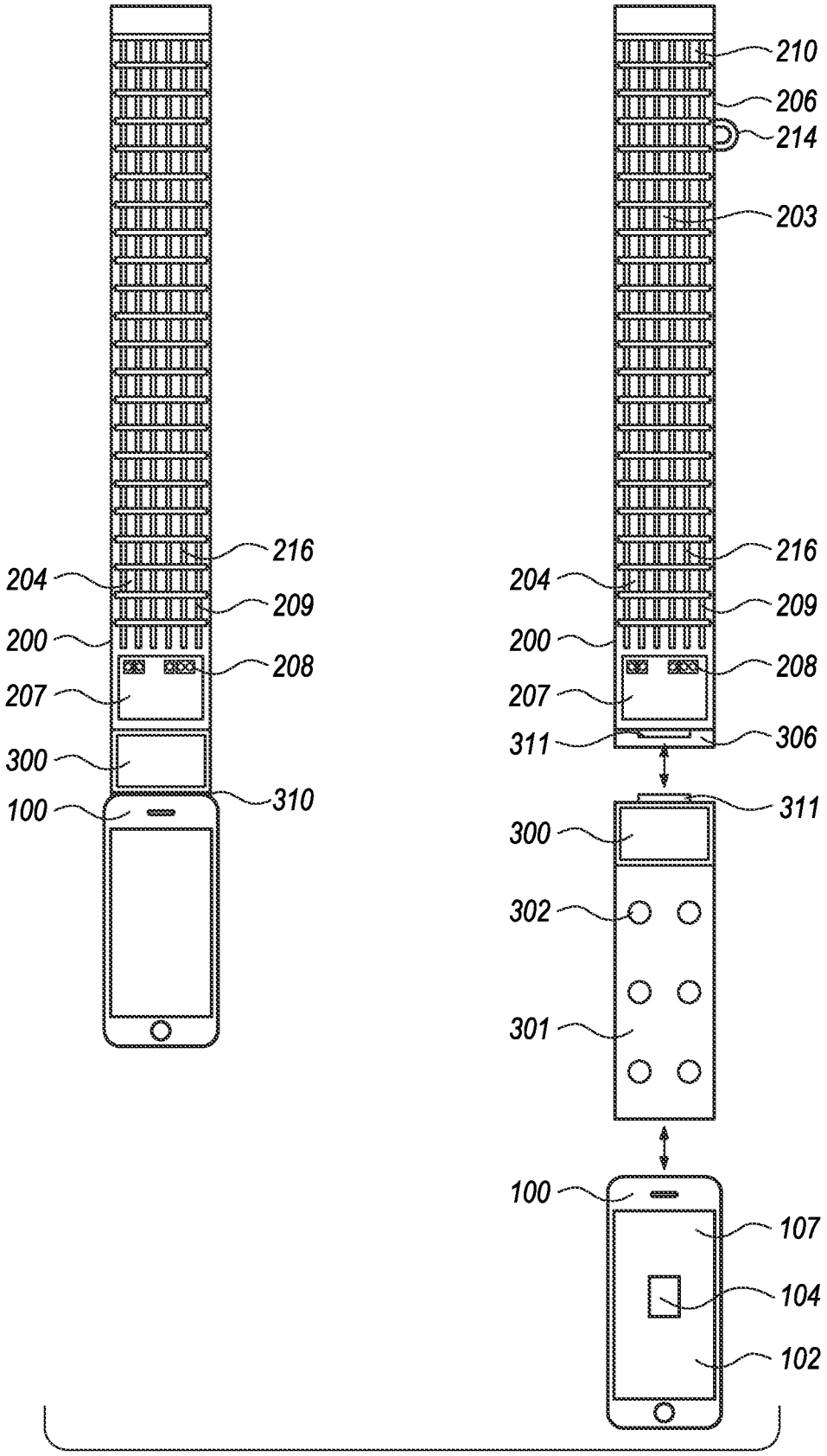
FIG. 60 shows a front plan view of the dock 300, fingerboard 200 and wireless play device 100 in one embodiment of the present invention.

With reference to FIGS. 60, 3 and 37, shown are front views of a phone 101 connected to the dock 300 and fingerboard 200. As shown, the dock 300 and fingerboard 200 are preferably joined and connected at the junction of surfaces 306 that are at opposing angles to each other.

Figure 4:
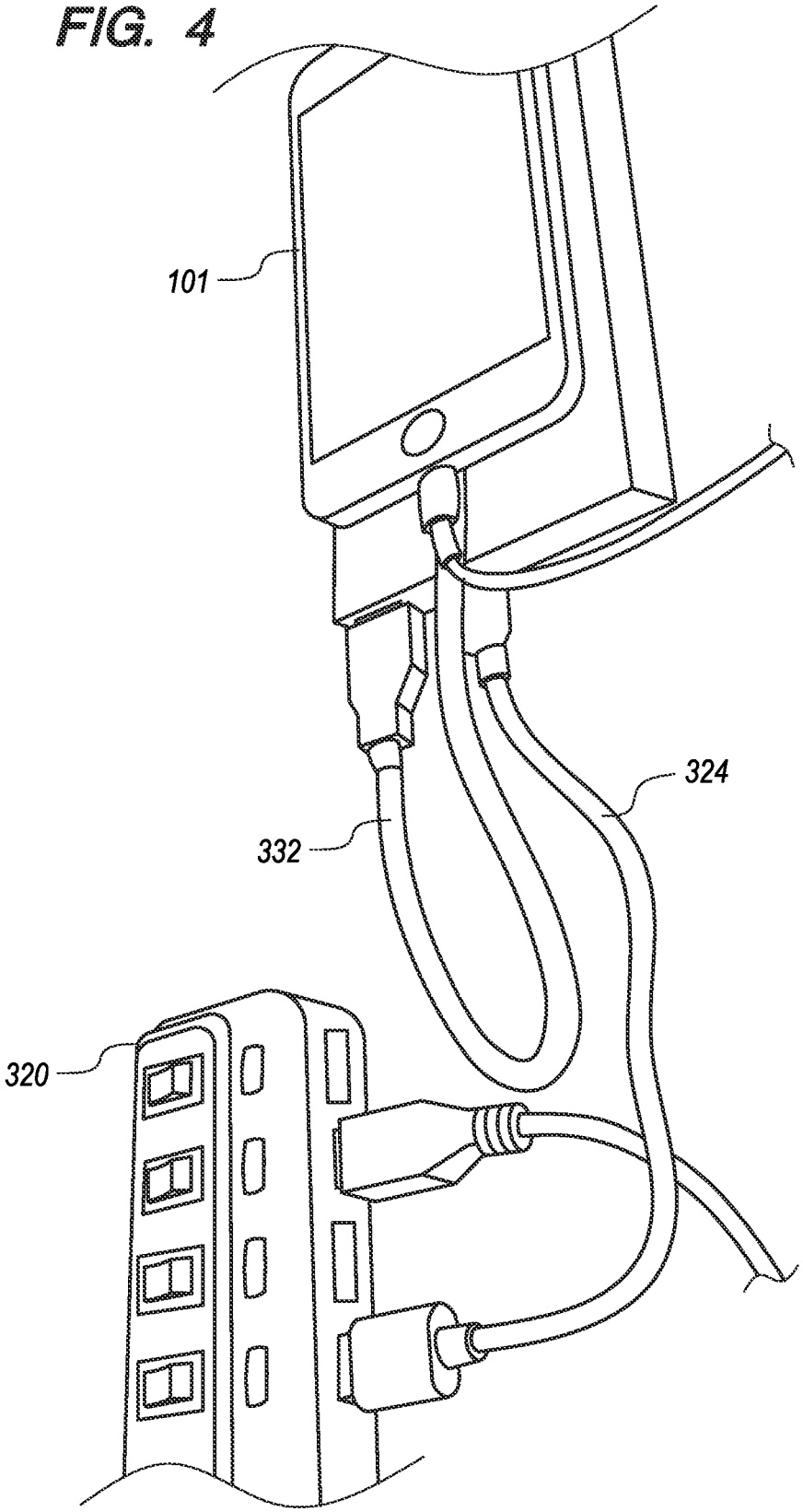
FIG. 4 shows a front perspective view of wireless phone 101 inserted in dock 300 of alternative form to that shown in FIGS. 1 to 3 and with power cables 324 and data cables 332 inserted therein of the present invention.

With reference to FIG. 4, shown is a front perspective view of a wireless phone 101 inserted in the dock 300 of an alternative form to that shown in FIGS. 1 to 3 and with power and data cables 324, 332 inserted therein of the present invention. As shown, an off the shelf power bank 321 can be incorporated as part of the dock 300 to accomplish this embodiment. Alternatively, data cables and data connectors 305, 332, 333, 334 can be incorporated to pass through the dock 300 to the data connectors 201, 202, 332, 333, 334 of the fingerboard 200 (see also, FIGS. 15, 19, 42, 46, 47 and 59).

Figure 5:
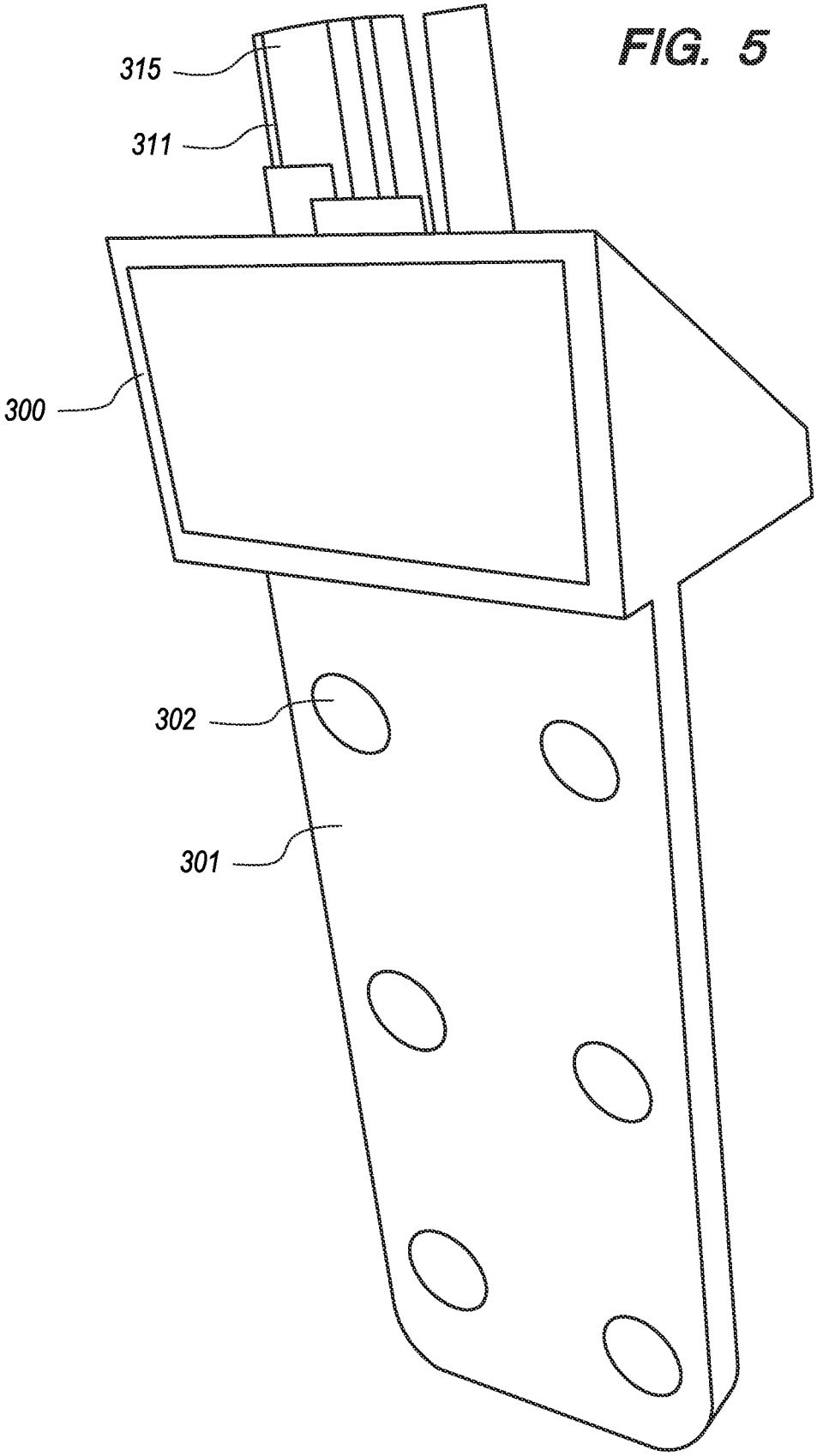
FIG. 5 shows a front perspective view of part of dock 300 of FIGS. 1 to 3 of the present invention without wireless phone 101 inserted.
Figure 43:
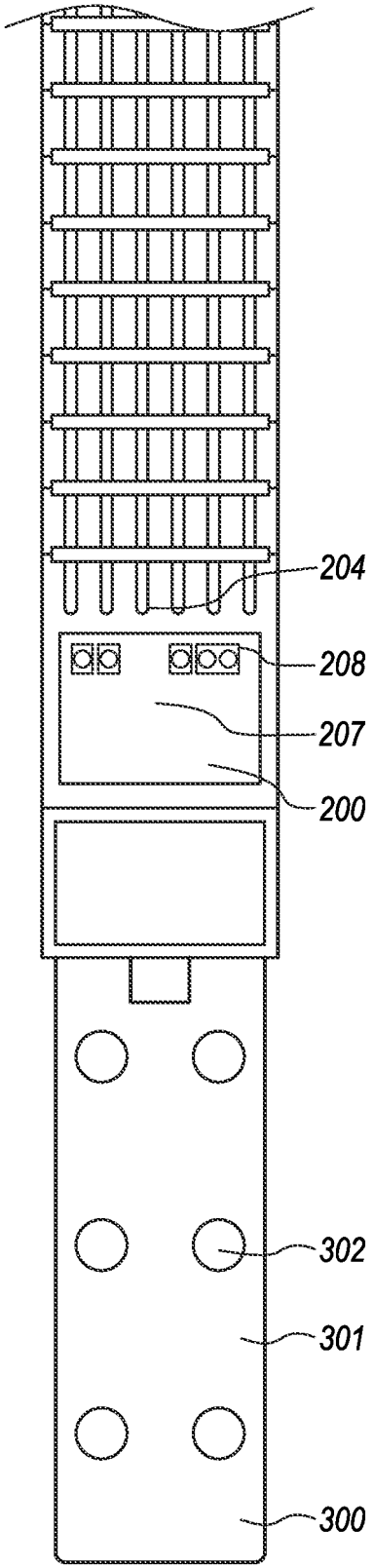
FIG. 43 shows a front perspective view of part of dock 300 without wireless phone 101 inserted and with magnets 302 inserted and docked with fingerboard 200 of present invention.
Figure 44:
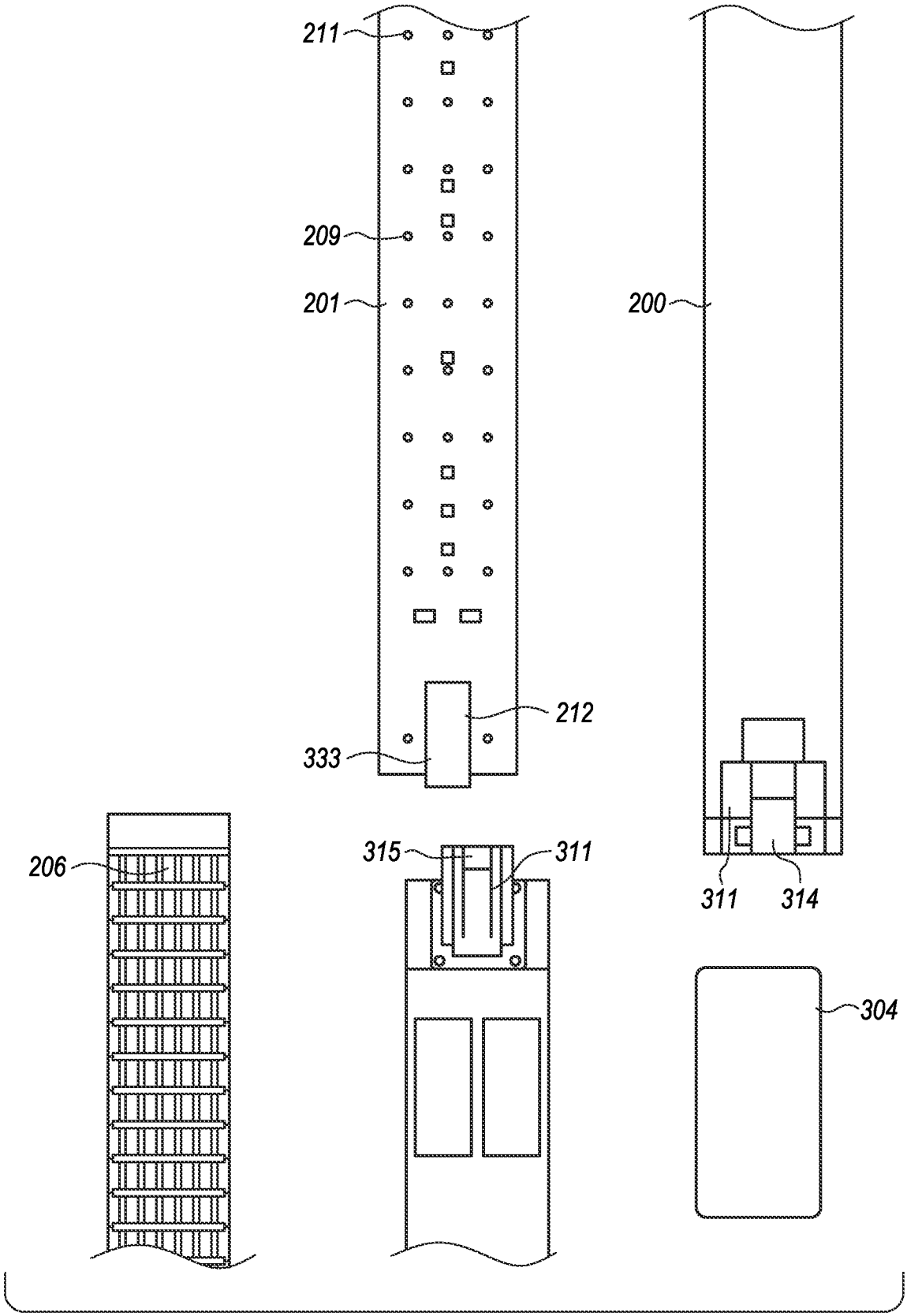
FIG. 44 shows a back plan view of dock 300, with cover plate separate 323, and battery pack 321 and finger board 200 disassembled of the present invention.
Figure 45:
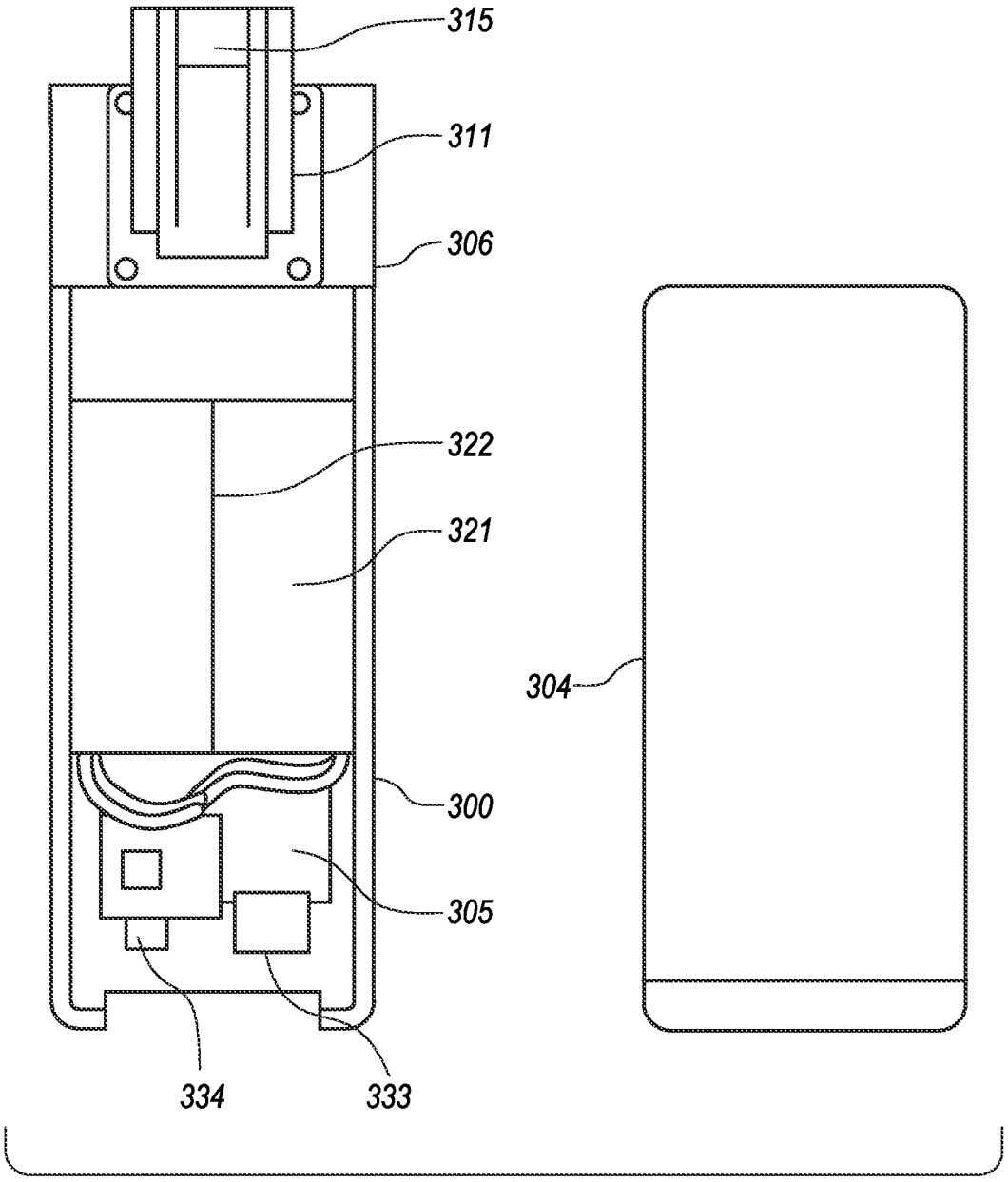
FIG. 45 shows back perspective view of dock 300 including battery pack 321 in battery cavity 322 and cover plate separate 323 in one embodiment of present invention.
Figure 46:
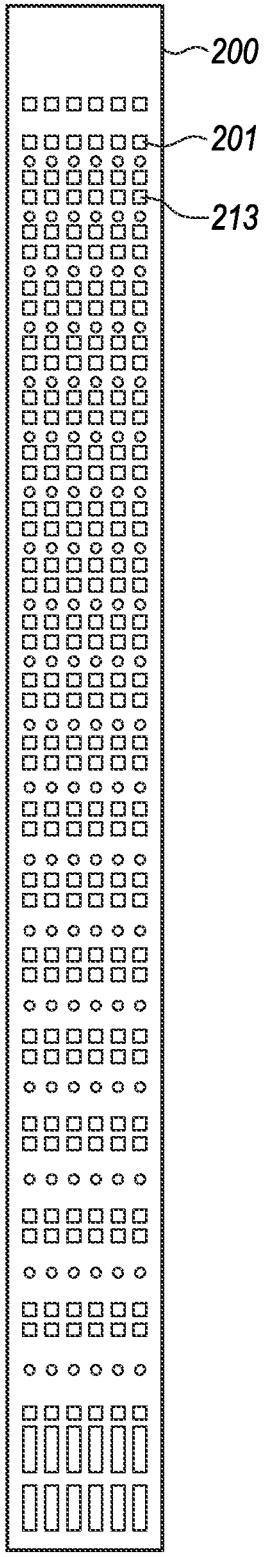
FIG. 46 shows a front plan view of sensor board 201 for fingerboard 200 of present invention.
Figure 47:
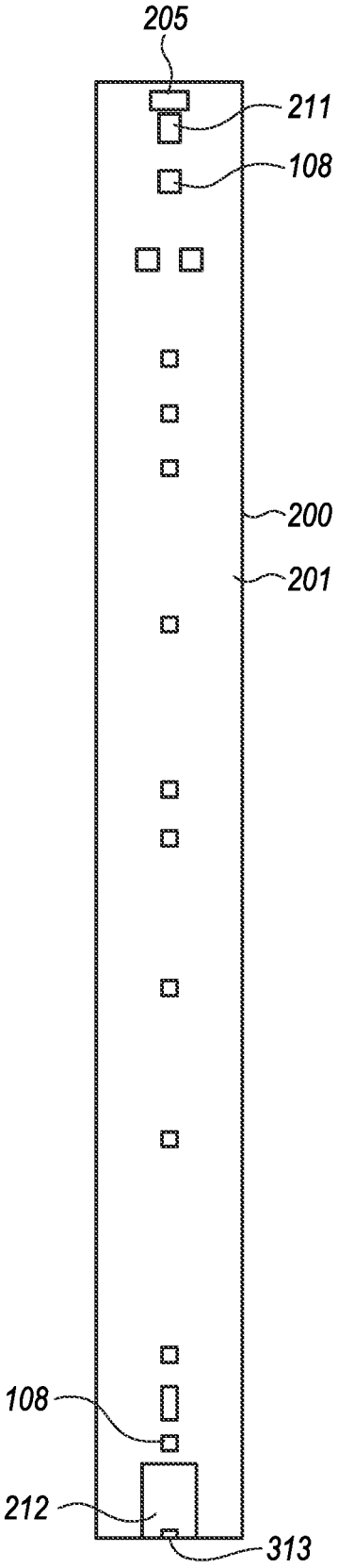
FIG. 47 shows a back plan view of circuit board 201 for fingerboard 200 of present invention.
Figure 48:
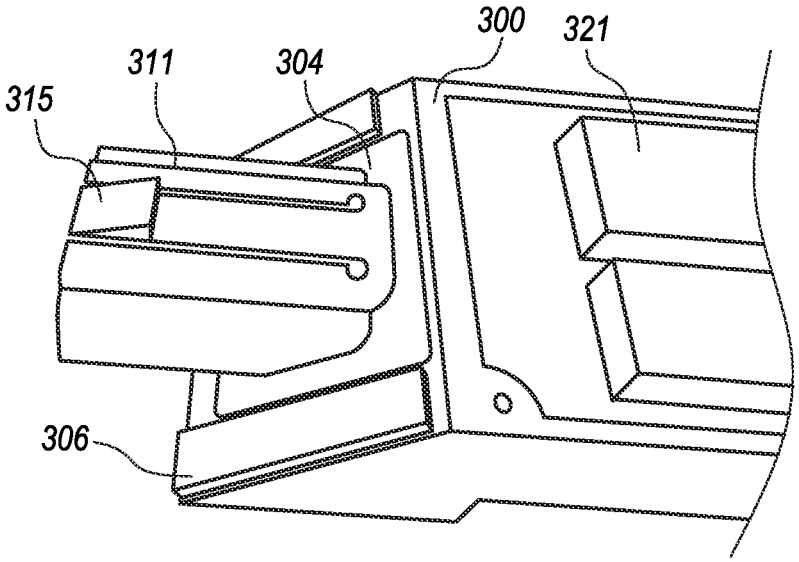
FIG. 48 shows a side perspective view of part of joinder mechanism 311 between dock 300 and fingerboard 200 of present invention.
Figure 49:
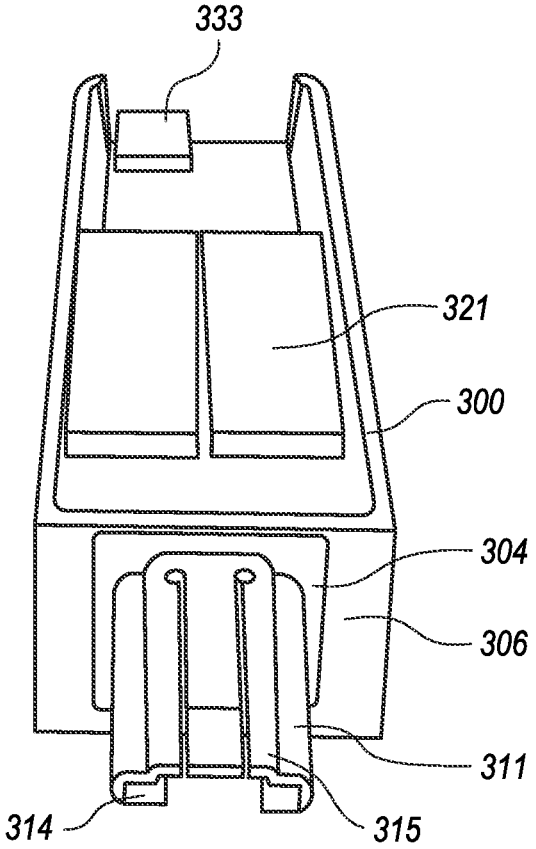
FIG. 49 shows a front perspective view of part of joinder mechanism 311 between dock 300 and fingerboard 200 of present invention.
Figure 50:
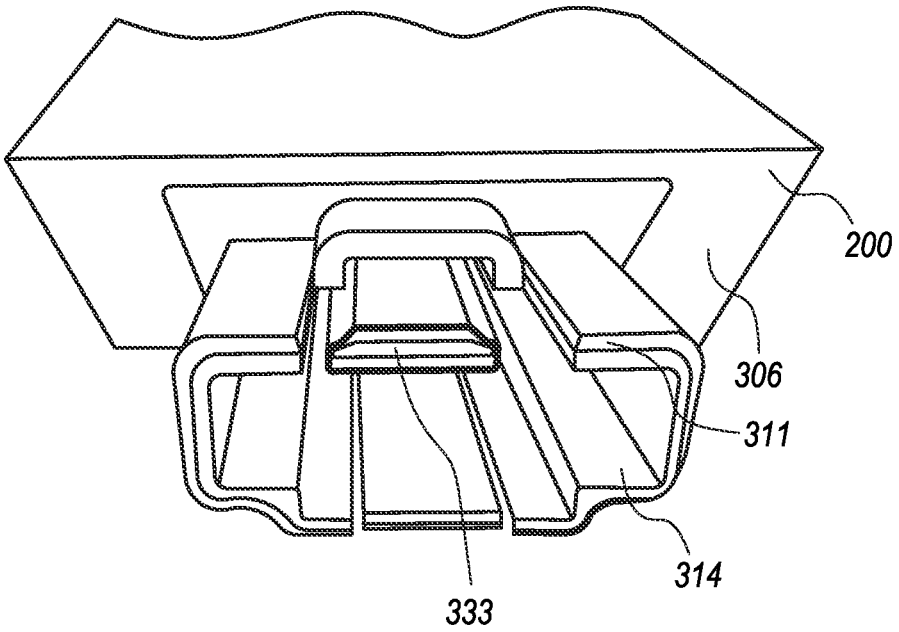
FIG. 50 shows a front end view of part of joinder mechanism 311 between dock 300 and fingerboard 200 of present invention.
Figure 51:
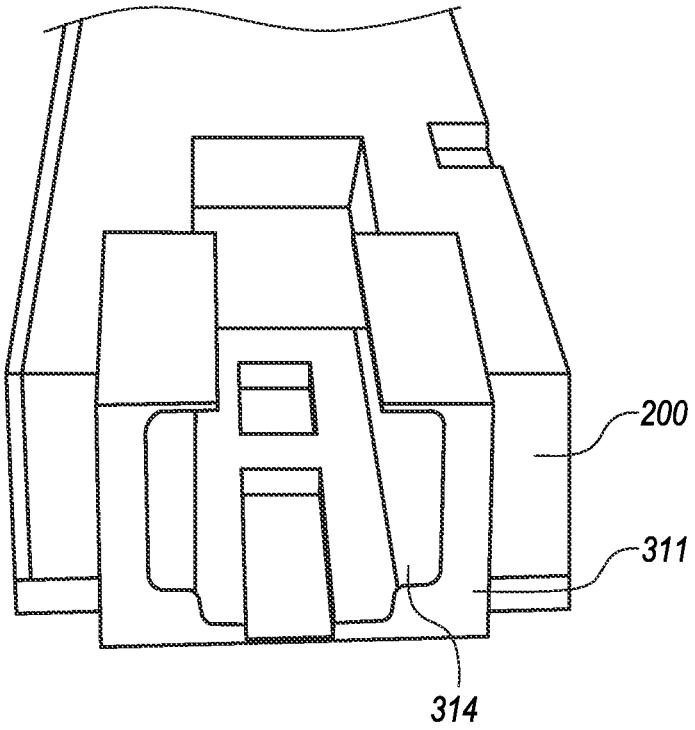
FIG. 51 shows a front perspective view of part of joinder mechanism 311 of fingerboard 200 of present invention.

With reference to FIGS. 5 and 43, as shown are front perspective views of part of dock 300 of FIGS. 60, 1 to 3 and 36 of the present invention without wireless phone 101 inserted. As shown, there is a docking surface 301 including openings with magnets 302 inserted therein. There is also an angled surface 206 for junction to the fingerboard 200, as well as joinder extensions 315 for forming the bond between the dock 300 and fingerboard 200.

With reference to FIG. 6 and FIGS. 37 and 39 and 60, as shown is a front perspective view of part of dock 300 of FIGS. 1 to 3 and FIG. 37 of the present invention with wireless phone 101 inserted. Here, the phone 101 is mounted on the docking surface 301 of the dock 300 by way of magnets 302. The phone, and other smart devices such as tablets 101, could be mounted on the docking surface 301 by other means, such as adhesives, or mounted to the dock 300 by other means, such as brackets as referenced above.

Figure 6:
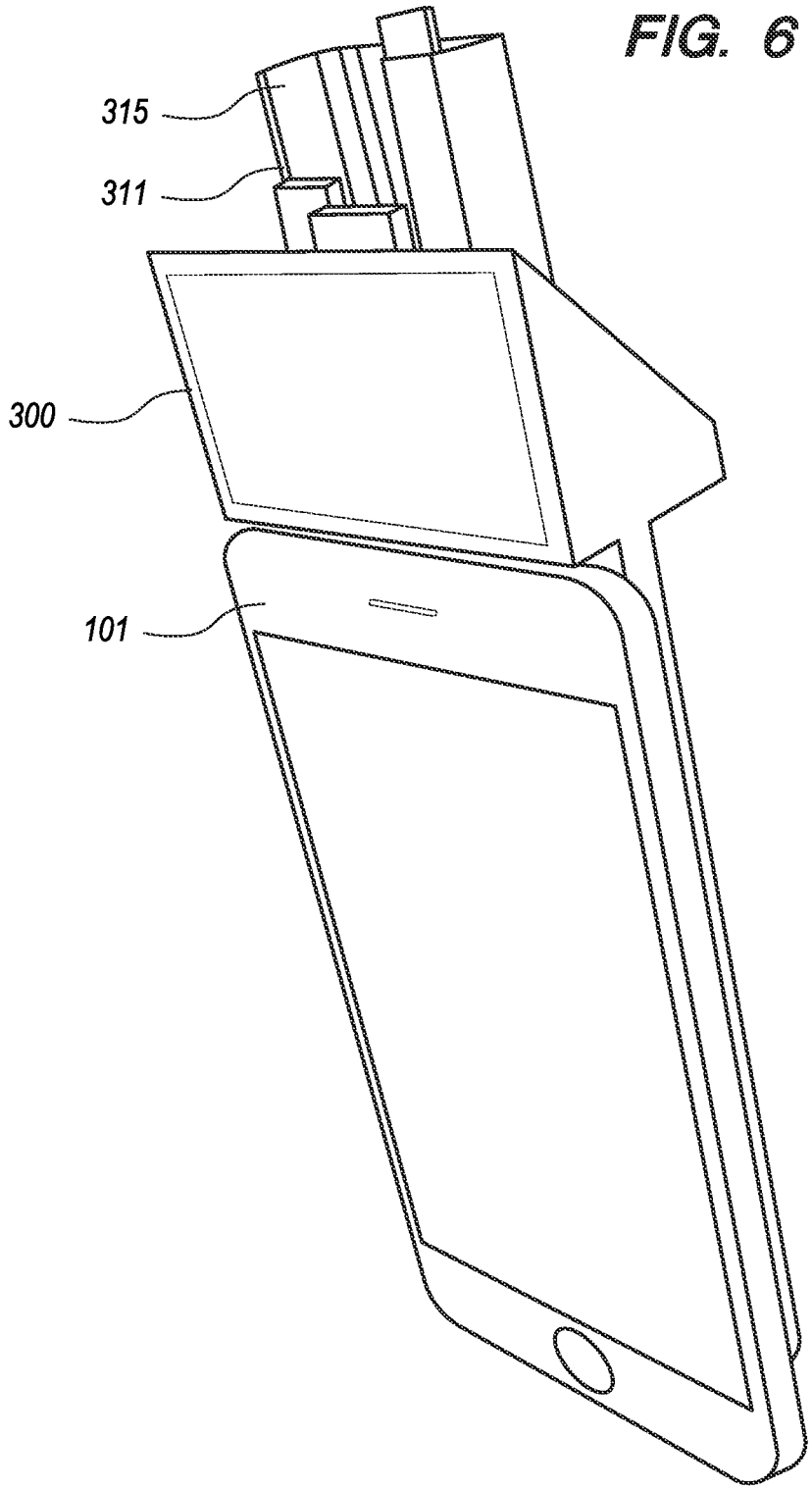
FIG. 6 shows a front perspective view of part of dock 300 of FIG. 5 of the present invention with wireless phone 101 inserted.
Figure 7:
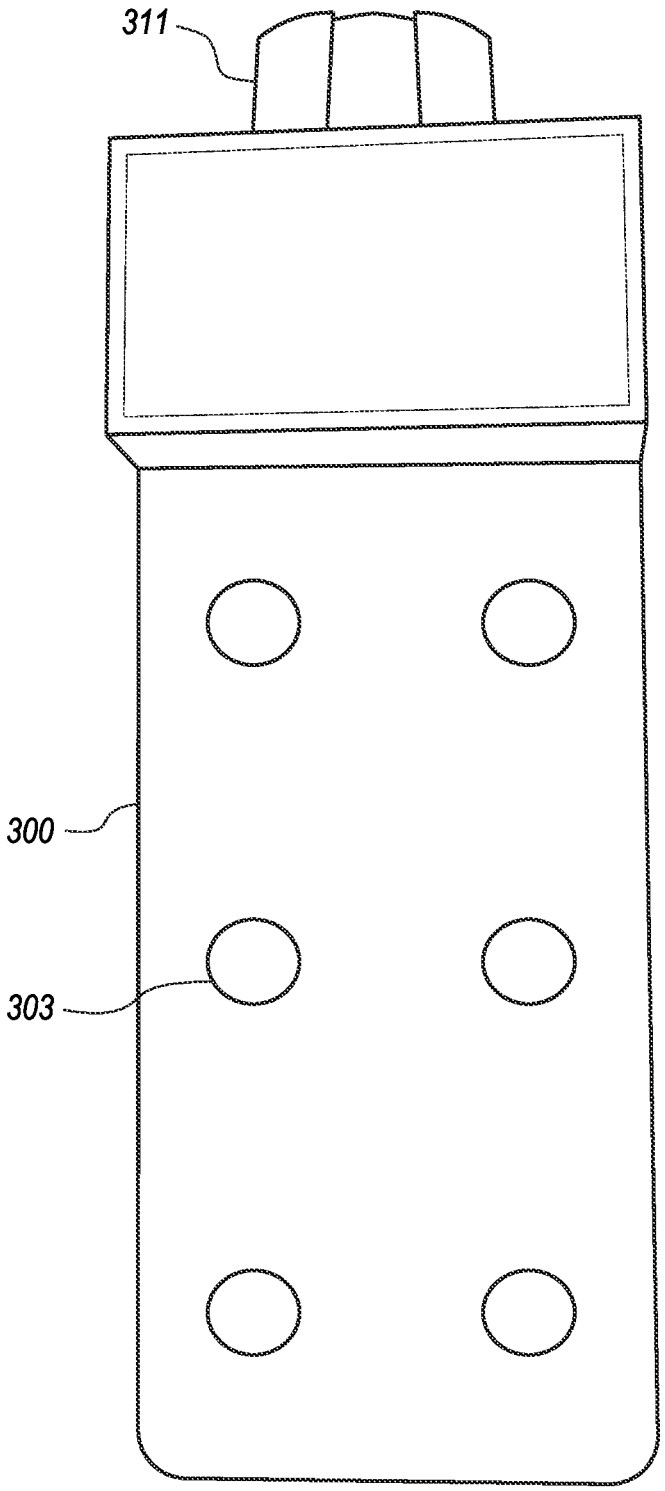
FIG. 7 shows a front plan view of part of dock 300 of FIG. 6 without wireless phone 101 inserted and showing spaces 303 for insertion of magnets 302 in dock 300 of present invention.

With reference to FIG. 7, as shown is a front plan view of part of dock 300 of FIG. 6 without wireless phone 101 inserted and showing openings or spaces 303 for insertion of magnets in dock 300 of present invention.

Figure 9:
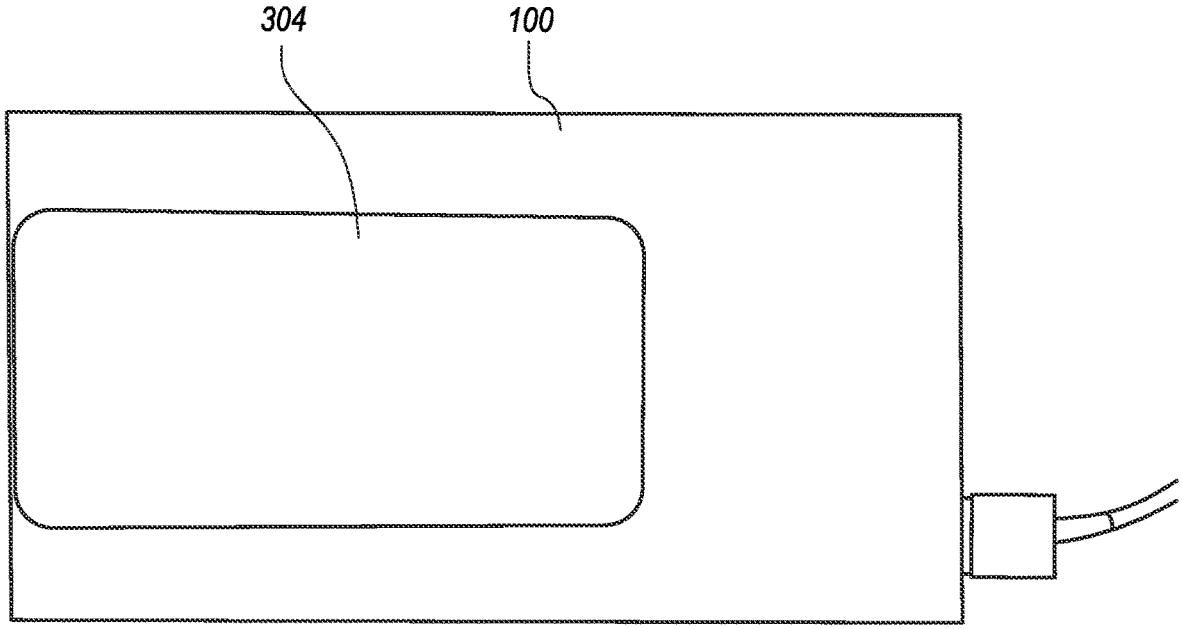
FIG. 9 shows a back plan view of smart play device 100 with metal plate 304 for adherence to magnets 302 of the dock 300 of the present invention.
Figure 64:
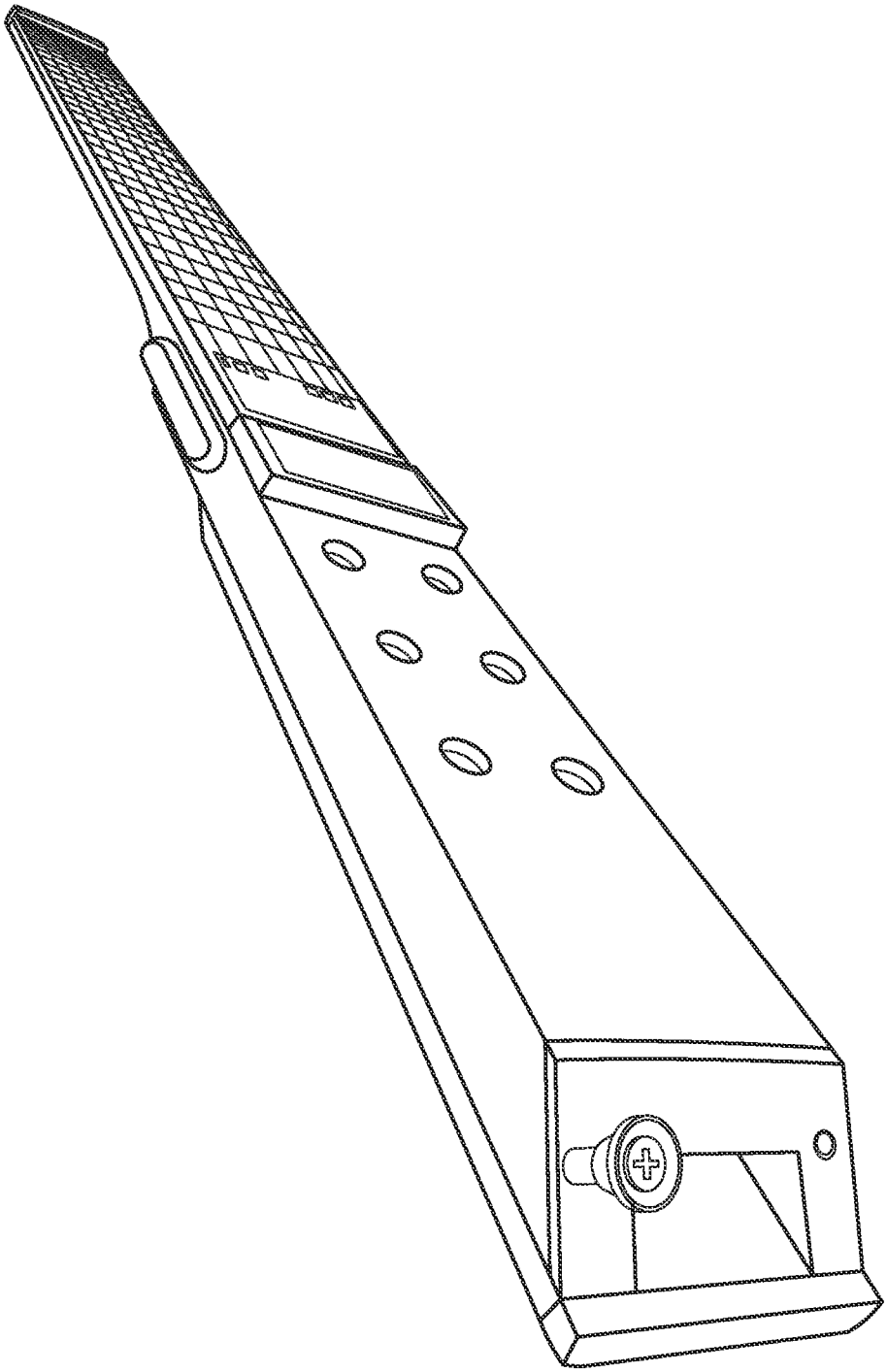
FIG. 64 shows a front perspective view of fingerboard 200 and dock 300 joined as a unitary device absent a joinder mechanism 311 embodiment of the present invention.
Figure 65:
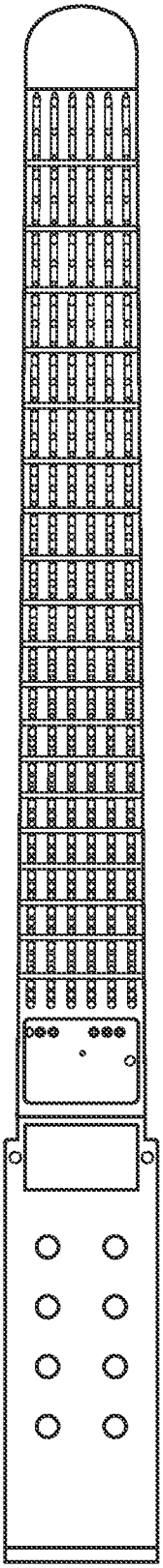
FIG. 65 shows a front plan view of the embodiment in FIG. 64.
Figure 66:
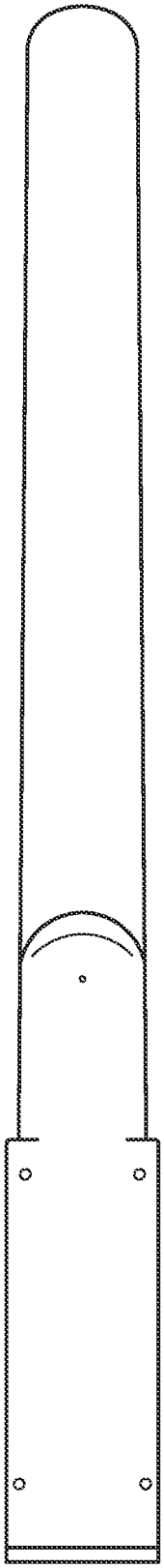
FIG. 66 shows a back plan view of the embodiment in FIG. 64.
Figure 67:
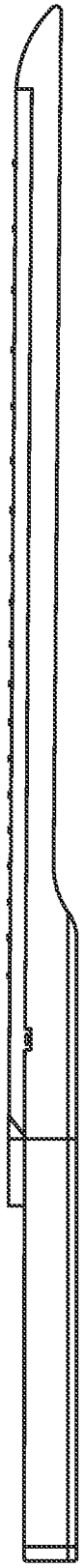
FIG. 67 shows a right side plan view of the embodiment in FIG. 64.
Figure 68:
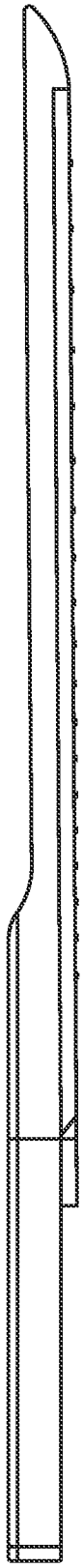
FIG. 68 shows a left side plan view of the embodiment in FIG. 64.
Figure 69:
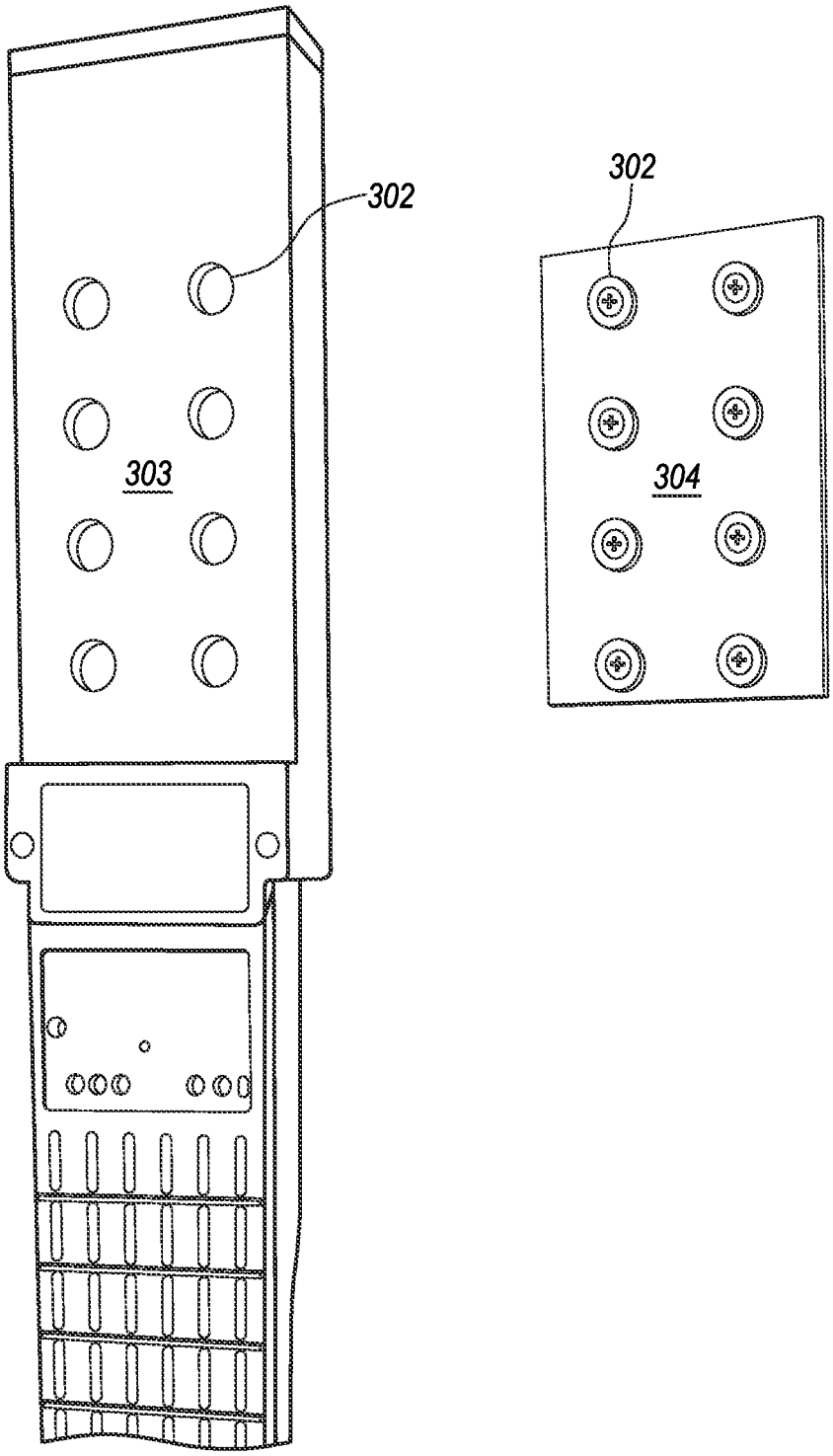
FIG. 69 shows a front perspective view of part of dock 300 of FIG. 64 showing recessed spaces 303 for insertion of magnets 302 in the embodiment of FIG. 64, including a separate plate 302 with added magnets 302, wherein the plate 302 can be attached to a play device 100.
Figure 70:
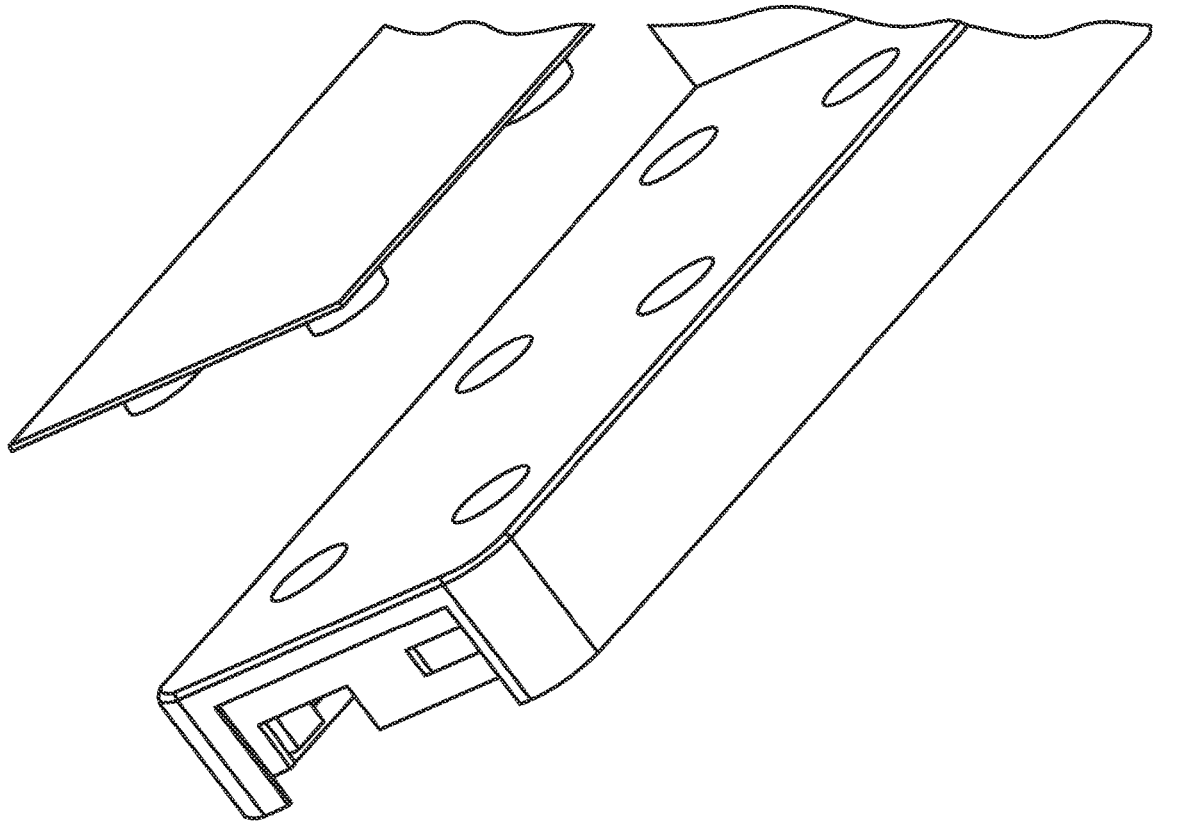
FIG. 70 shows another rendition of the arrangement for connection between the dock 300 and play device 100 shown in FIG. 69.

With reference to FIGS. 69 and 70, they show a front perspective view of part of dock 300 of FIG. 64 showing recessed spaces 303 for insertion of magnets 302 in the embodiment of FIG. 64, including a separate plate 302 with added magnets 302, wherein the plate 302 can be attached to a play device 100 (see, e.g., FIG. 9). As such, the attachment of the play device 100 to the dock 300 is further accomplished with deepened recesses 303 in the dock and magnets 302 on the plate 304 which are received in the recesses 303. Thus, the magnets provided joinder and connection energy and means in a z direction perpendicular to the surface of the dock 300 and plate 304 and the joinder of the magnets 303 on the plate 304 in the recesses 303 of the dock 300 provide connection in x and y directions parallel to the surface of the dock 300 and plate 304. As such, the play device with such a plate 304 with magnets 302 inserted in such recesses 303 of dock 300 avoids slippage and has a very secure fit. For example, once secured, the plate 304 cannot be shaken off nor can it be twisted or rotated from its preferred position. This arrangement of recesses 303 and magnets 302 on one surface and plates 304 and magnets 302 on another surface, such as a plate connected to a device 100, to more securely join and attach two surfaces has application outside of joinder of a play device 100 to a dock 300. It could be used to join and attach a variety of devices to surfaces, or devices to devices or any two components using magnets, plates and recesses.

Figure 8:
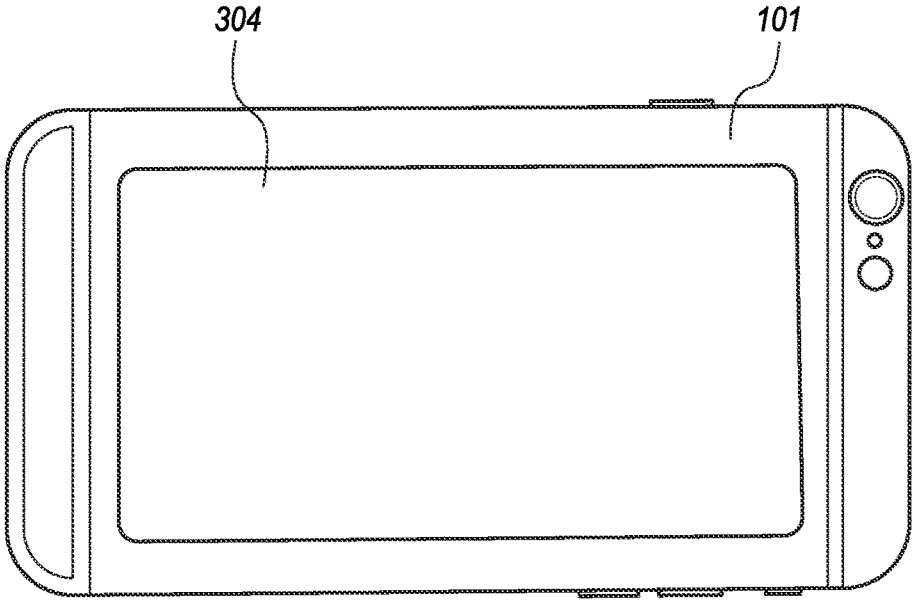
FIG. 8 shows a back plan view of wireless phone 101 with metal plate 304 for adherence to magnets 302 of the dock 300 of the present invention.

With reference to FIG. 8, as shown is a back plan view of the wireless phone 101 with a metal plate 304 attached thereto for adherence to magnets 302 of the dock 300 of the present invention.

With reference to FIG. 9, as shown is a back plan view of a smart device 101 with a metal plate 304 attached thereto for adherence to the magnets 302 of the dock 300 of the present invention.

Figure 10:
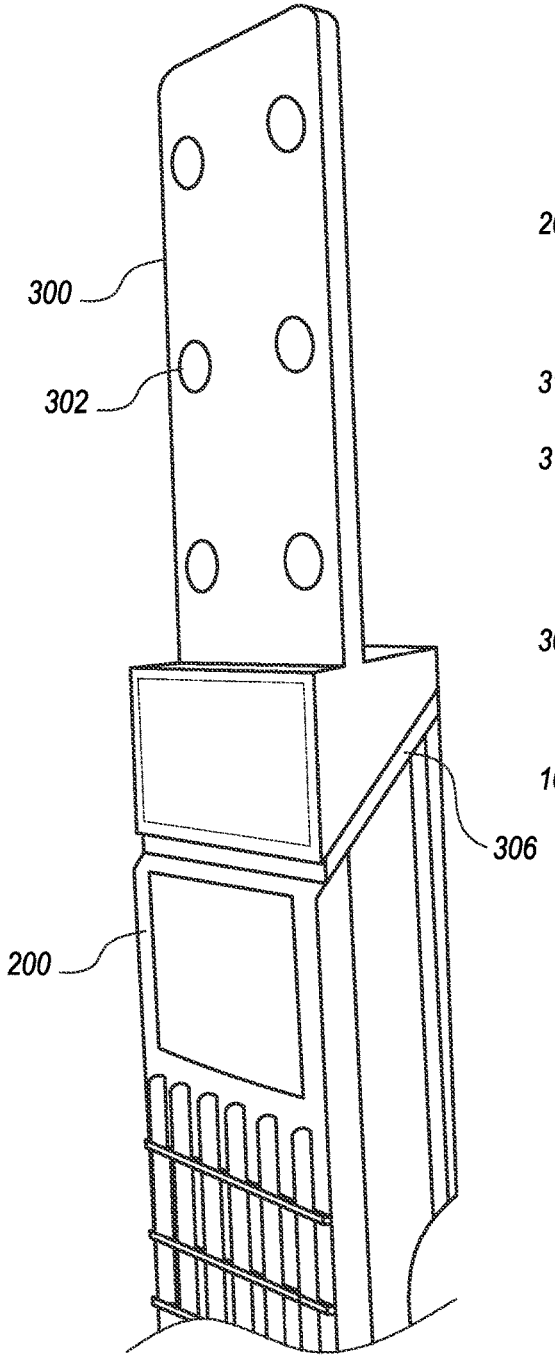
FIG. 10 shows a front perspective view of part of dock 300 without wireless phone 101 inserted and with magnets 302 inserted and docked with fingerboard 200 of present invention.

With reference to FIGS. 10 and 43, as shown are front perspective views of part of the dock 300 without wireless phone inserted, with magnets inserted and further joined with fingerboard 200 of present invention at surfaces that are at opposing angles to each other.

Figure 11:
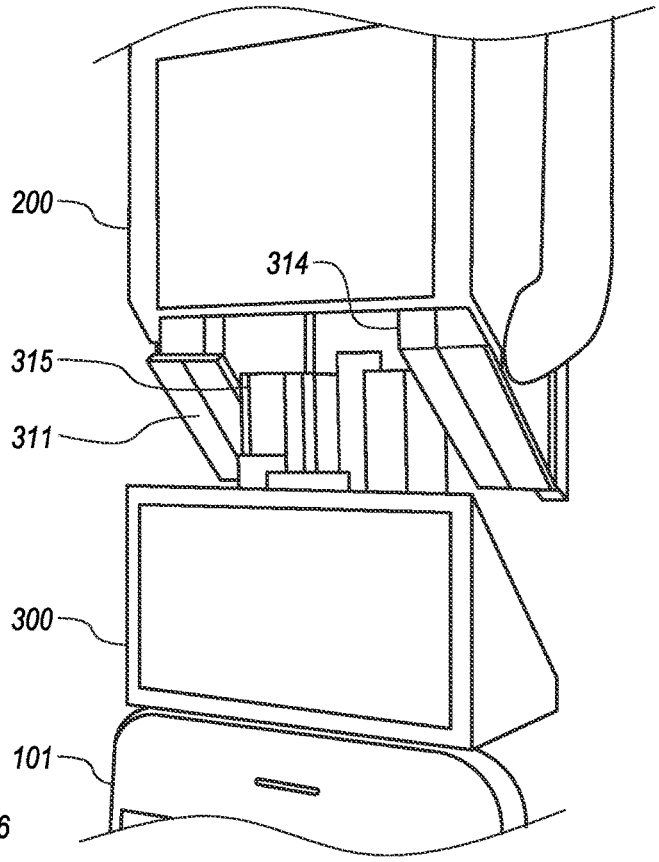
FIG. 11 shows a perspective view of part of joinder mechanism 311 between dock 300 and fingerboard 200 of present invention.
Figure 62:
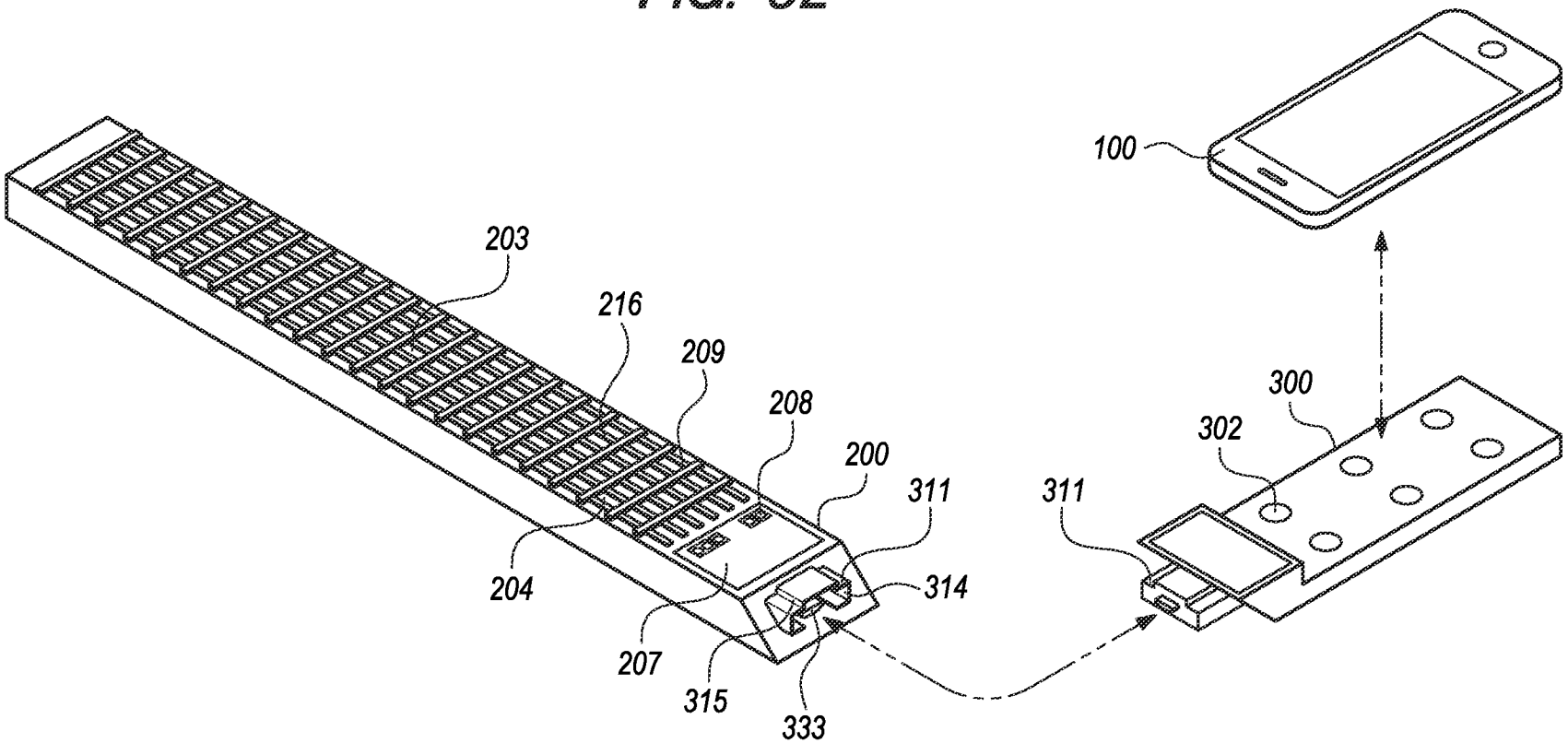
FIG. 62 shows a perspective view of joinder mechanism 311 of the dock 300 and finger board 200 in one embodiment of the present invention.

With reference to FIGS. 62 and 11, as shown is a perspective view of part of the joinder mechanisms 311 between dock 300 and fingerboard 200 of present invention.

As shown, the dock 300 has one or more extension members 315 comprising the dock joinder mechanism 311, and the fingerboard 200 has structure 315 defining seats and/or openings 314, to receive such extensions 315 that comprise the joinder mechanism 311. The joinder mechanisms 311 are configured to join the dock 300 and fingerboard 200 and secure them horizontally and vertically. The joinder mechanisms 311 include a locking mechanism 313 to selectively secure and unsecure the dock 300 and fingerboard 200 joinder mechanisms 311 together. The extensions and openings 314, 315 may be made from any suitable material that is lightweight, sturdy, amenable to formation into particular shapes, and to the use of compatible shapes for joinder and selective locking.

Figure 12:
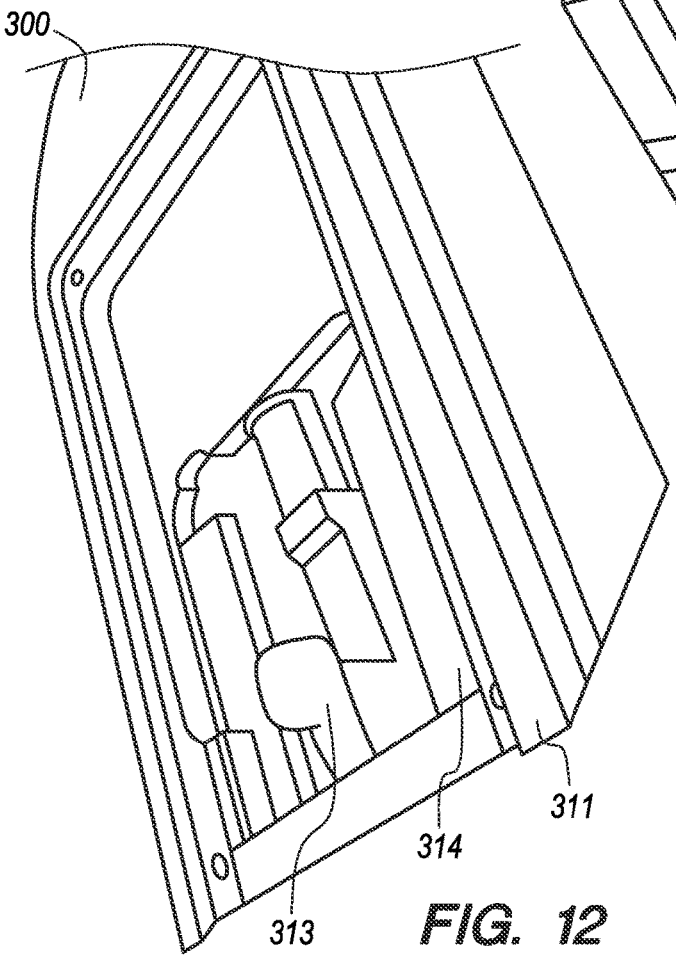
FIG. 12 shows a back perspective view of part of joinder mechanism 311 of fingerboard 200 of present invention.

With reference to FIG. 12, as shown is a back perspective view of part of the joinder mechanism 311 of the fingerboard 200 and dock 300 of the present invention. See also FIG. 62. As shown, the joinder mechanism 311 includes openings and seats 314 to receive extensions 315. As also shown, and as also with respect to FIGS. 2 and 14 and 62, the fingerboard 200 defines a cavity 322 for housing a battery 321 for powering the circuitry 201 of the fingerboard 200, circuitry 305 of the dock and/or the circuitry of the phone, tablet and/or box 100. As also shown, the fingerboard 200 includes the aforementioned button or knob extension 313 for use in selectively securing and unsecuring the dock 300 and finger joinder mechanisms 311 together.

Figure 13:
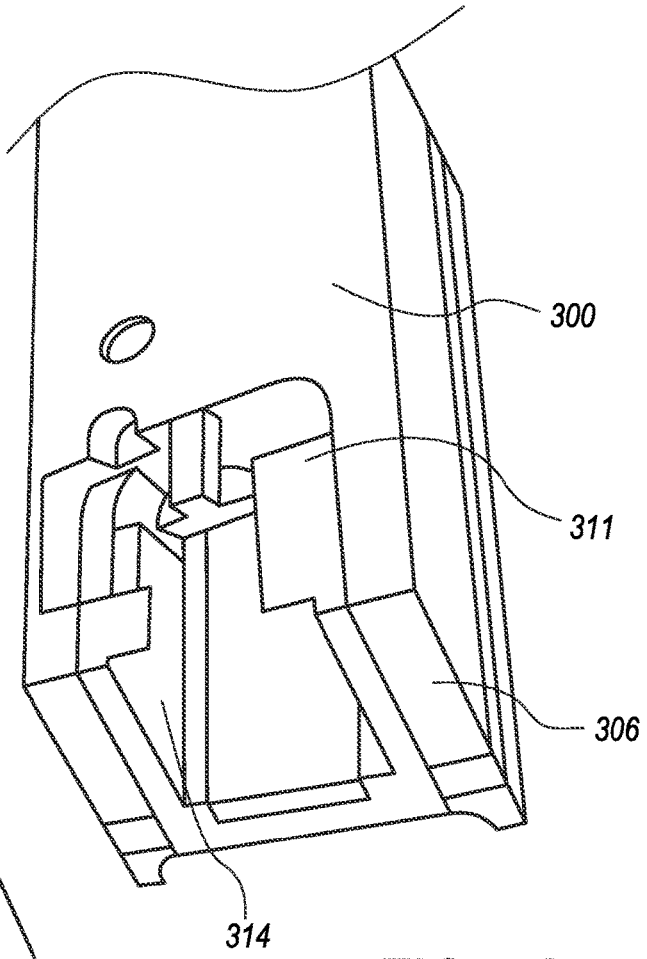
FIG. 13 shows a front perspective view of part of joinder mechanism 311 of fingerboard 200 of present invention.

With reference to FIG. 13, as shown is a front perspective view of part of the joinder mechanism 311 of the present invention, including structure defining openings 314 to receive extensions 315.

With reference to FIG. 14, as shown is a back perspective view of part of the joinder mechanism 311 of the fingerboard 200 and dock 300 of the present invention, similar to FIG. 12, but with battery 321 inserted in the cavity 322.

With reference to FIG. 15, as shown is a back plan view of the dock 300 in an alternative embodiment to that of FIGS. 2, 12 and 14 for purposes of housing a battery 321, wherein the dock 300 defines a cavity 322 for a battery pack 321. As also shown, an additional trough 322 is formed along the length of the bottom of the cavity, which may be used to place cabling 324, 332, such as for connectors (e.g., 333, 334), through the dock 300 to be joined with, for example, the data connectors 333 of the fingerboard 200 as further shown in FIGS. 18 and 19. As also shown, the dock 300 includes extensions 315 comprising the joinder mechanism 311.

With reference to FIGS. 62, 44, 45 and 48-51, as shown are various views of an alternative embodiment of the joinder mechanism 311 of the fingerboard 200 and dock 300 of the present invention. As shown, the joinder mechanism 311 similarly includes openings 314 to receive corresponding extensions 315, and the fingerboard 200 defines a cavity 322 for housing a battery 321 for powering the circuitry 201, 202 of the fingerboard 200 and/or the phone, tablet and/or box 100. As also shown, the fingerboard 200 includes the aforementioned button or knob 313 extension for use in selectively securing and unsecuring the dock 300 and fingerboard 200 joinder mechanisms 311 together.

The battery 321 for powering the fingerboard 200 could also be separate and/or stand-alone (e.g., not incorporated into the dock 300 or fingerboard 200). Such a battery 321, as well as a battery 321 incorporated into the body of the dock 300 or finger board 200 as shown in FIGS. 14 and 15, could power not only the fingerboard 200 but also the smart device 101 or string box 110 or box devices 120 of the various embodiments of the invention.

Figure 16:
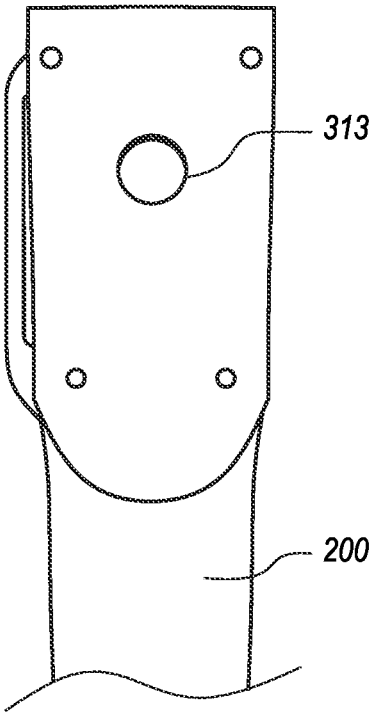
FIG. 16 shows a back plan view of fingerboard 200 including opening 312 for accessing closing and opening mechanism 313 for joinder mechanism 311 of present invention.

With reference to FIGS. 61 and 16, as shown is a back plan view of the fingerboard 200 including a cover plate 304 over the battery cavity 322 and an opening 312 for the button or knob extension 313 use in selectively securing and unsecuring the dock 300 and fingerboard 200 joinder mechanism 311 together.

Figure 17:
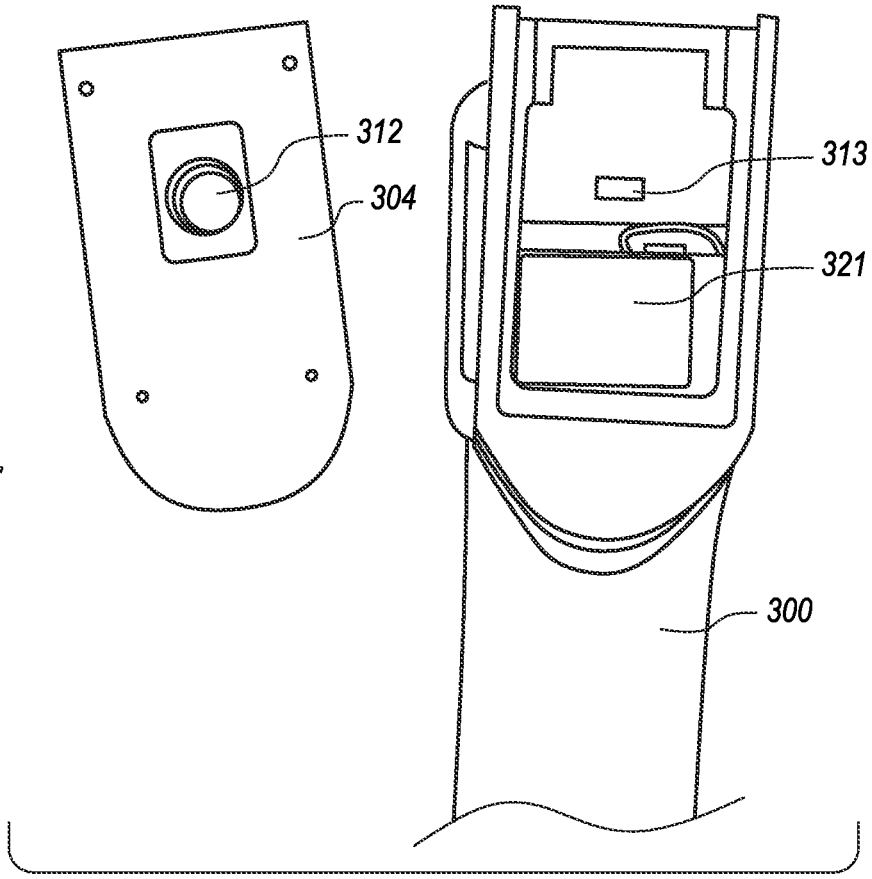
FIG. 17 shows a back plan view of fingerboard 200 and dock 300 including opening 312 for accessing closing and opening mechanism for joinder mechanism in open position to show battery pack 321 for insertion into cavity 322 and cover 323 regarding such opening 312 of present invention.

With reference to FIG. 17, as shown is a back plan view of the fingerboard 200 similar to FIG. 16 but with the cover plate 312 detached and turned over to show its underside and to expose and show the battery 321 in the cavity 321 and the button or knob 313.

Figure 18:
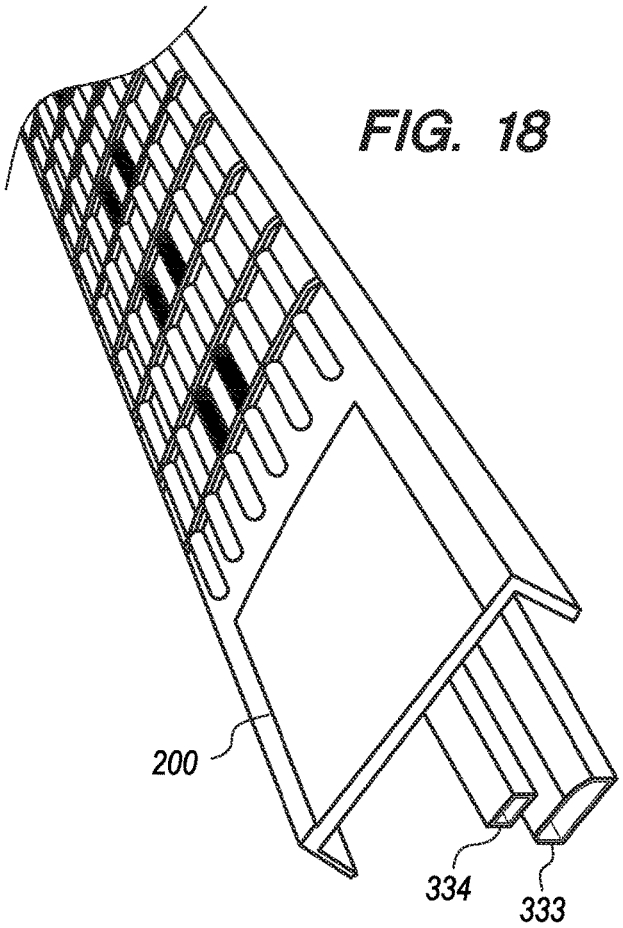
FIG. 18 shows perspective view of part of fingerboard 200 and including data connector 333 of present invention.

With reference to FIG. 18, shown is perspective view of part of the fingerboard 200, absent structure of the joinder mechanism 311 shown in FIGS. 11, 12 and 13, and including data connectors 333, 334 of present invention. As shown, the top data connector 334 is USB compatible for connection to data connectors for phones by example and the bottom connector 333 is HDMI compatible for connection to data connectors 333 for the string box 110 by example.

Figure 19:
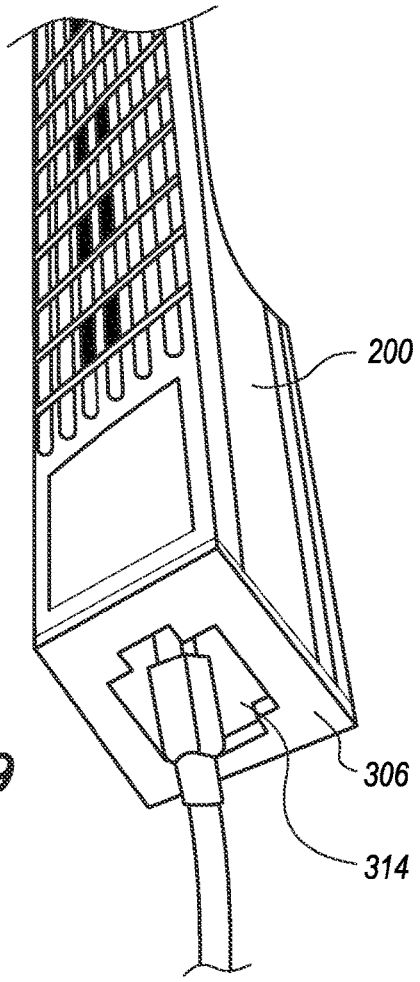
FIG. 19 shows perspective view of part of fingerboard 200 and including USB connector 334 with data connector plate 335 and data cable 332 inserted in data connector 333 of present invention.

With reference to FIG. 19, shown is a perspective view of part of fingerboard 200 and including USB and HDMI data connectors 333, 334 with data connector plate 335 and data cable 332 inserted in data connector 333 of present invention. By contrast to FIG. 18, structure of the joinder mechanism 311 shown in FIGS. 11, 12 and 13 is included along with an additional cover plate 335 over the surface of the joinder mechanism 311 that forms an opposing angle 306 to the corresponding surface 305 of the joinder mechanism 311.

Figure 20:
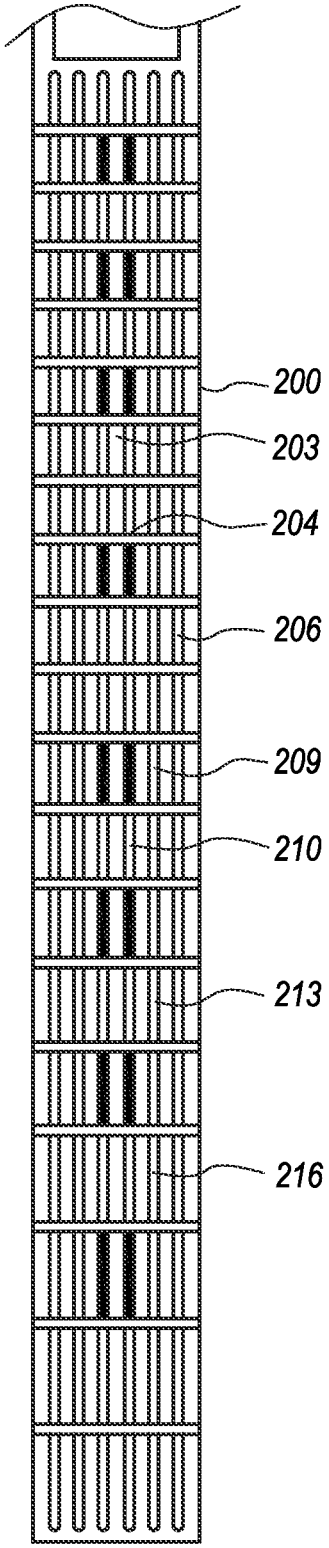
FIG. 20 shows a front plan view of fingerboard 200 of present invention.
Figure 38:
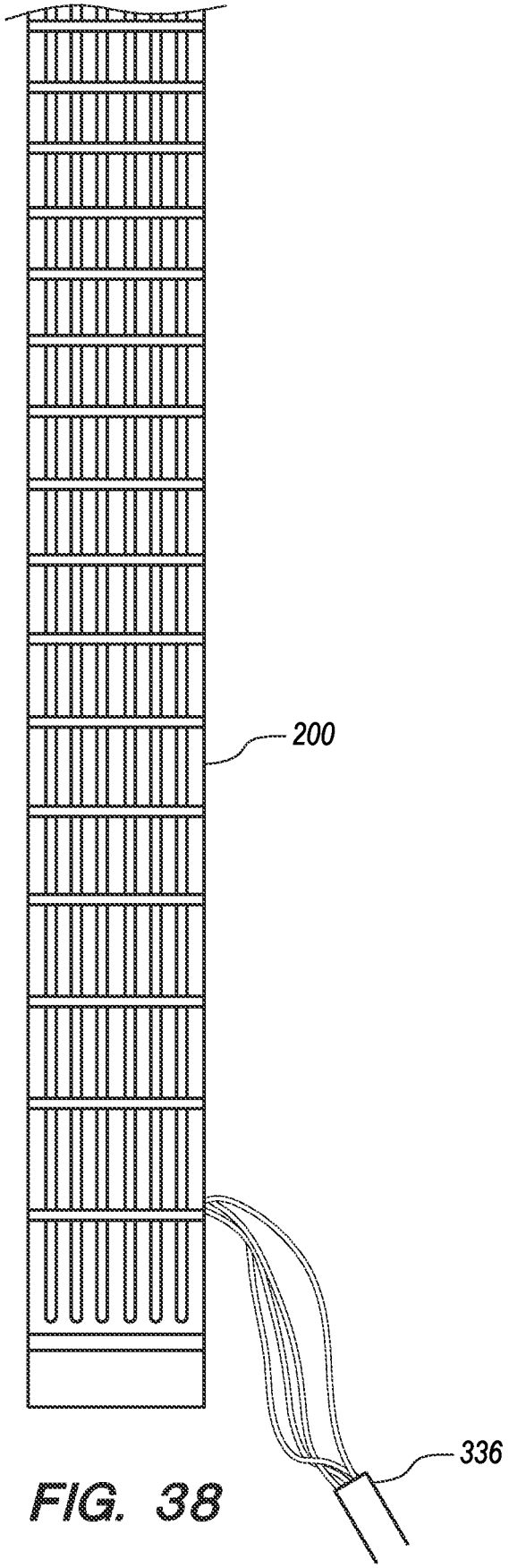
FIG. 38 shows a front plan view of a fingerboard 200 of the present invention.
Figure 39:
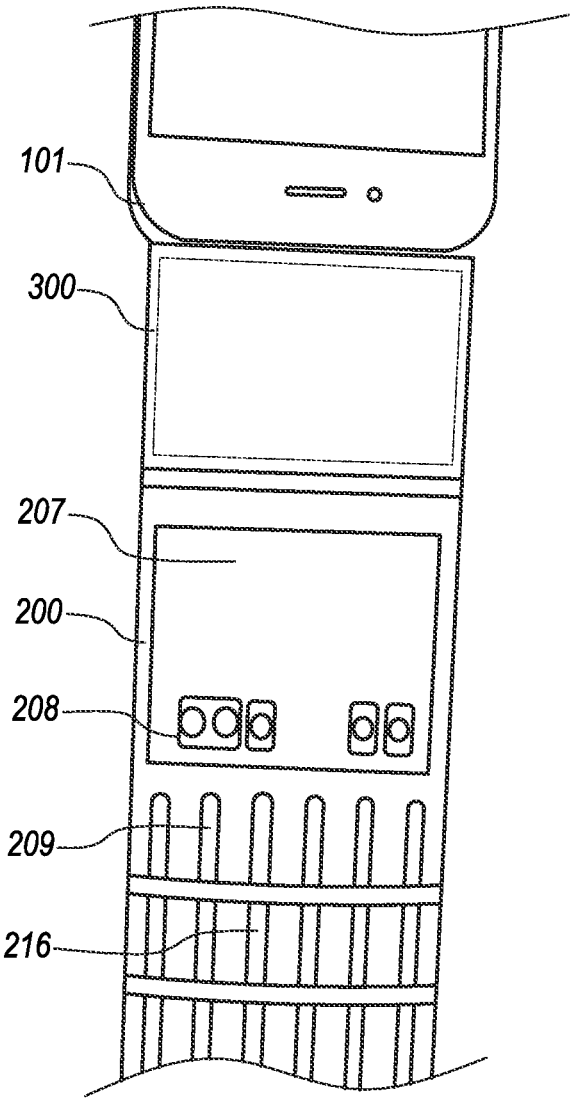
FIG. 39 shows a front plan view of a fingerboard 200 and dock 300 with wireless phone 101 inserted of the present invention.
Figure 40:
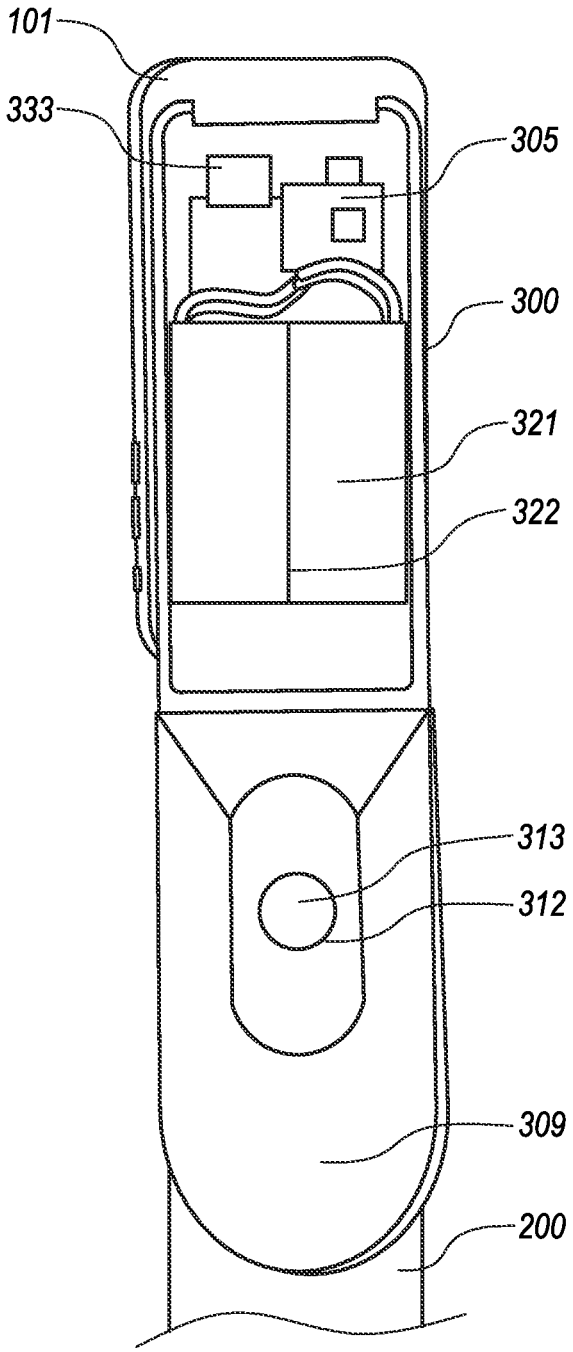
FIG. 40 shows back perspective view of dock 300 including battery pack 321 in battery cavity 322 in one embodiment of present invention.

With reference to FIGS. 20 and 38 and 60, shown are front plan views of the face of the fingerboard 200 of present invention in two embodiments. As shown, the face 210 of the fingerboard 200 is configured to represent and provide functionality of a fretboard of a guitar and/or keyboard of a musical instrument based on the circuitry 201 included, as well applications 104 of the play device 101 used, as described below. As further shown in FIG. 38, electronic and wireless extensions and connectors 324, 332, 333, 334 can be incorporated into the fingerboard 200 to connect with ancillary devices, such as power sources 321, scanners, communication devices and devices 100 for providing sound and lights and programming therefore. Similarly, antennae 336 can also be included as part of the circuitry of the fingerboard 200 or dock 300 and extend from either to communicate with ancillary receivers and transmitters. As further shown in FIGS. 21 and 22, as well as FIGS. 45 to 47, a variety of components and circuitry 201, 305 can be used to form this structure and accomplish such functionality, and applicant hereby incorporates by this reference the disclosures of U.S. Pat. No. 5,398,585 entitled "Fingerboard for Musical Instrument" and U.S. Pat. Publ. No. 20080271594 entitled "Electronic Musical Instrument" regarding same. In the embodiment in FIGS. 36 to 47, the Bluetooth and main scanner processors 211 are located at the end of the fingerboard 200 opposite the dock 300, and the LED processor and main CPU 212 are located at the end of the fingerboard 200 adjacent the docket. However, these processors and circuitry could be arranged alternatively. The various processors, e.g., main scanner processor, LED controller, Bluetooth radio controller and CPU also comprise or are otherwise operable with multiple code bases, along with the code base for the applications described below.

It is further contemplated that the fingerboard 200 face may embody or otherwise include a variety of fingerboard 200 devices, including but not limited to, a full-length 6 string×24 fret fingerboard 200, a short 6 string×6 fret fingerboard 200, or any combination of rows and columns, a fingerboard 200 that accepts a pressure sensor 213 wherein pressing the sensor 213 and/or sensor board 202 while playing will cause a programmable musical effect, a fingerboard 200 whose note-locations incorporate both a side-pressure mechanism and a longitudinal position (see FIG. 22 at 202, 212), an LED-enabled fingerboard 200 equipped with 2-way communication to allow the smart device 101 to send interactive LED information to the fingerboard 200 to light the LEDs 216 for educational and/or entertainment purposes, or a fingerboard 200 which communicates via wireless data interface and requires no direct connection with the dock 300. For example, FIGS. 20 and 36-38 illustrate a lighted keyboard 200, 204.

Figure 21:
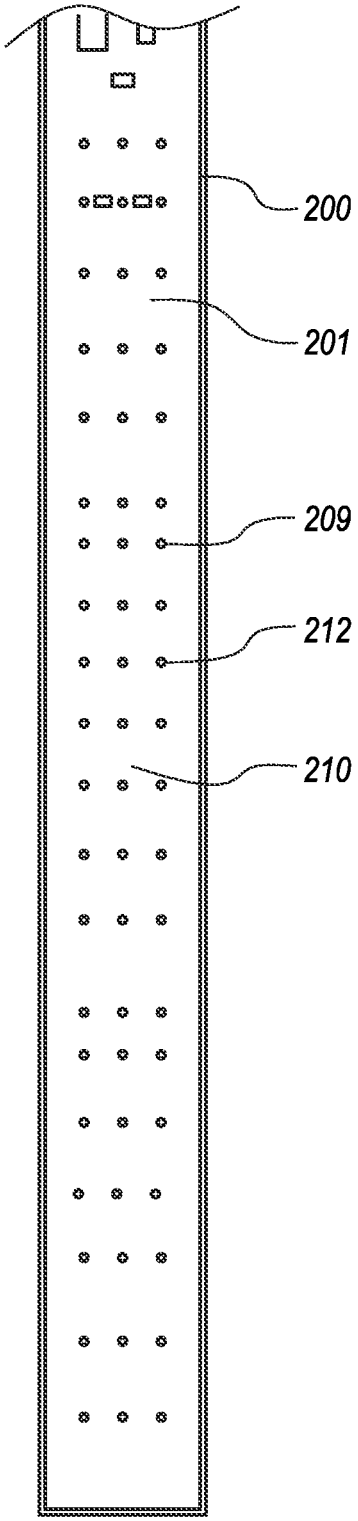
FIG. 21 shows a front plan view of circuit board 201 for fingerboard 200 of present invention.

With reference to FIG. 21, shown is a front plan view of the circuit board 201 underlying the face for the fingerboard 200 of the present invention. This circuitry 201 facilitates capturing and generating signals based on user pressure applied to the strings or keys 209 and frets and sensors 212 on the face 210 of the fingerboard 200.

Figure 22:
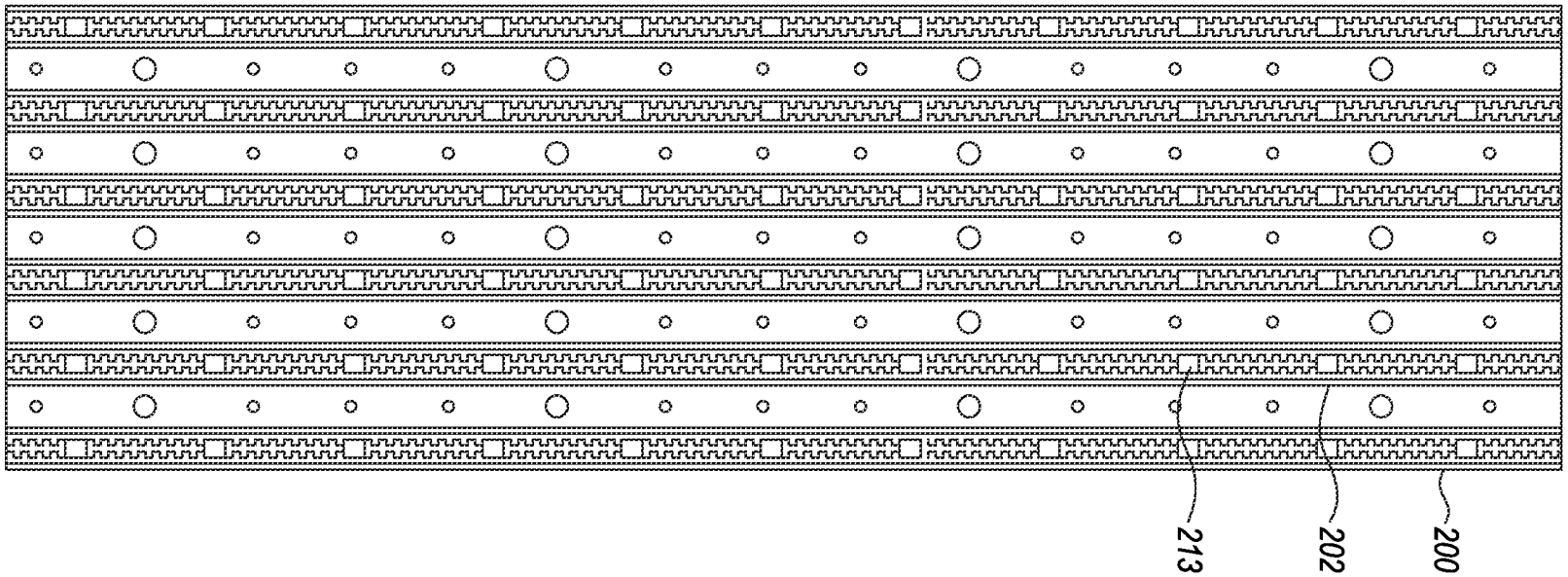
FIG. 22 shows a front plan view of sensor board 202 for fingerboard 200 of present invention.

With reference to FIG. 22, shown is a front plan view of the sensor board 202 underlying the circuit board of FIG. 22, which also facilitates and generating such signals based on such pressure applied by users. This structure further includes side bend circuits 212 which further provide the ability to generate signals emulating guitar string bends. In one embodiment, the side bend circuits 212 are used by rolling a switch of the circuit to the side by applying a side-force to a key 209. By pressing in on the key, the domed contact compresses and engages the side bend circuit. The effect may be similar to that of violinist's vibrato.

Figure 23:
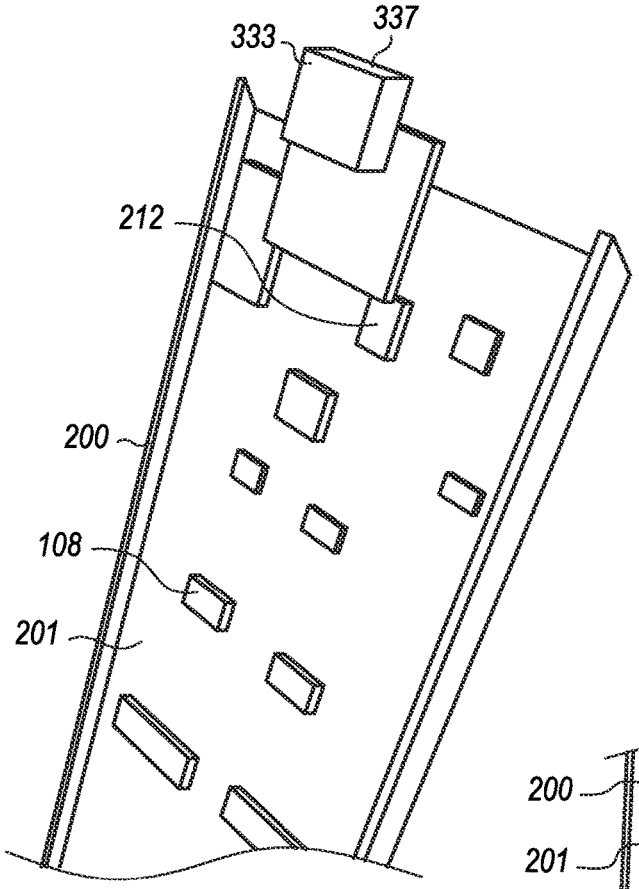
FIG. 23 shows a bottom perspective view of circuit board 201 and data connector 333 of fingerboard 200 of present invention.
Figure 25:
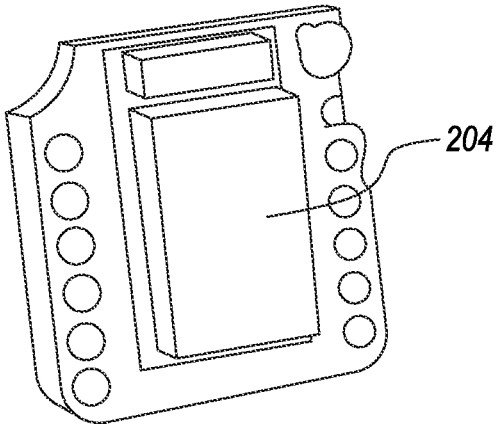
FIG. 25 shows blue tooth modulator chip 25 of present invention.

With reference to FIG. 23, shown is a bottom perspective view of the main circuit board 201 of the fingerboard 200 of the present invention. As shown, as in FIG. 18, but here in FIG. 23 from the bottom view, data connectors 333 are included which can be used to communicate with data connectors 333 of phones, tablets, string boxes and other user communication devices 100 preferably mounted on the dock 300. As also shown, and as shown in FIG. 25, the main circuit board 201 can includes a blue tooth modulator 205 for wireless communication with phones, tablets and other user communication devices 100 preferably mounted on the dock 300. As further shown, the main circuit board 201 further includes a CPU 212 for controlling and operating the fingerboard 200 and data communication with phones, tablets and other user communication devices 100, memory chips facilitating serial eprom, analog multiplexers for selecting and forwarding signals and battery charge circuitry. Input/output ports 337 for various serial interfaces may be included, e.g., MIDI/USB/SPI/TTL/Wireless. Ports 337 for input control hardware such as knobs, pads, sliders, whammy, strumming triggers, accelerometer and joystick may also be included. It is further contemplated that the fully integrated fingerboard 200 has the capability to control a LED lighting system (including LED's 216 in or under keys 209), have wireless/USB connectivity to other computer devices, and have the potential for expansion for additional performance controls, speakers, and/or microphones. Interactive embedded software may control lighting from the player's performance and touch on the instrument which may then be translated into lighting effects or elicit music-note based fingerboard 200 information such as scales and chords. Interactive software 108 may also allow for local lighting to be controlled by external computers.

Figure 24:
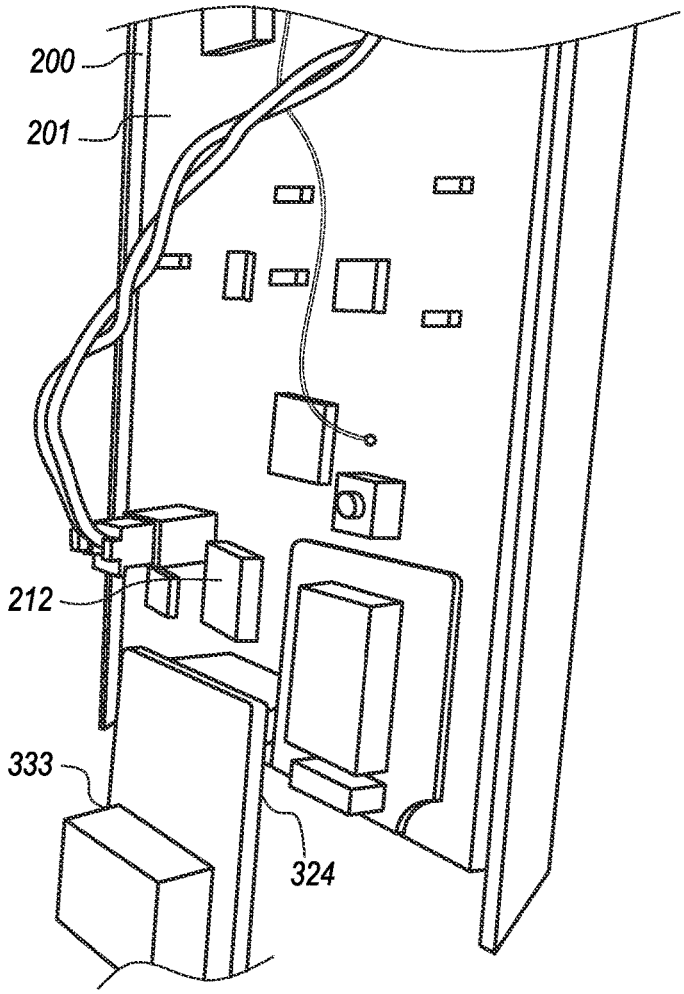
FIG. 24 shows a bottom perspective view of circuit board 201 and one embodiment of power connector 324 of fingerboard 200 of present invention.

With reference to FIG. 24, shown is a bottom perspective view of main circuit board 201 of the fingerboard 200 and one embodiment of a power and/or data connector 324, 333 to a power or data source, such as a battery 321 or processor 212, of the fingerboard 200 of present invention.

With reference to FIG. 25, shown is a blue tooth modulator chip 205 of present invention.

Figure 26:
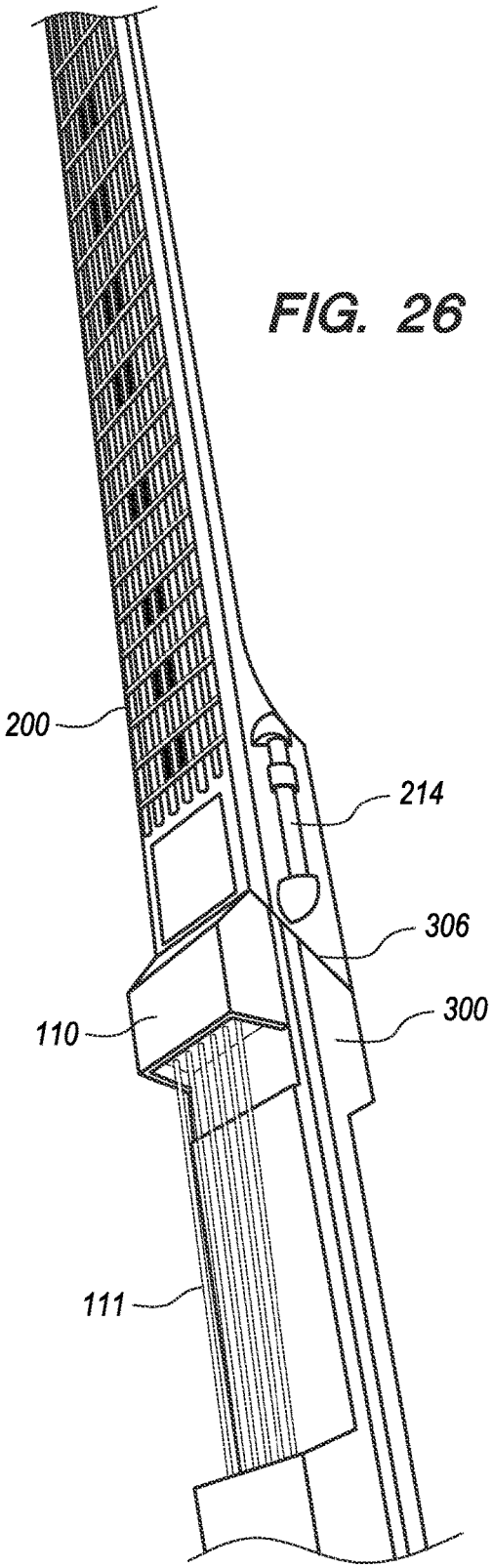
FIG. 26 shows a front perspective view of fingerboard 200 and dock 300 joined with string box 110 embodiment of the present invention.

With reference to FIG. 26, shown is a front perspective view, and FIGS. 60, 61 and 62 (front, back together and exploded view and perspective views regarding joinder mechanism 311) of the fingerboard 200 and dock 300 joined with together via the joinder mechanisms 311 described above and further including a string box 110 mounted to the dock 300 as opposed to a phone 101 as an alternative embodiment of the present invention. As shown, the strings 111 resemble the strings of a guitar and the string box 110 includes circuitry 112 to facilitate the generation and communications of signals with the circuitry 201 of the fingerboard 200 and/or circuitry 305 of the dock 300 and a data connectors 333 to couple and communicate with the dock 300 and fingerboard 200. As referenced above, the string box 110 is preferably digitally coupled to the fingerboard 200 via data connectors and cable 332, 333 of the string box 110 connected to data connectors 332, 333 of the dock 300 (see FIGS. 30 and 31 (using HDMI)). A serial line connection could alternatively be used.

Figure 27:
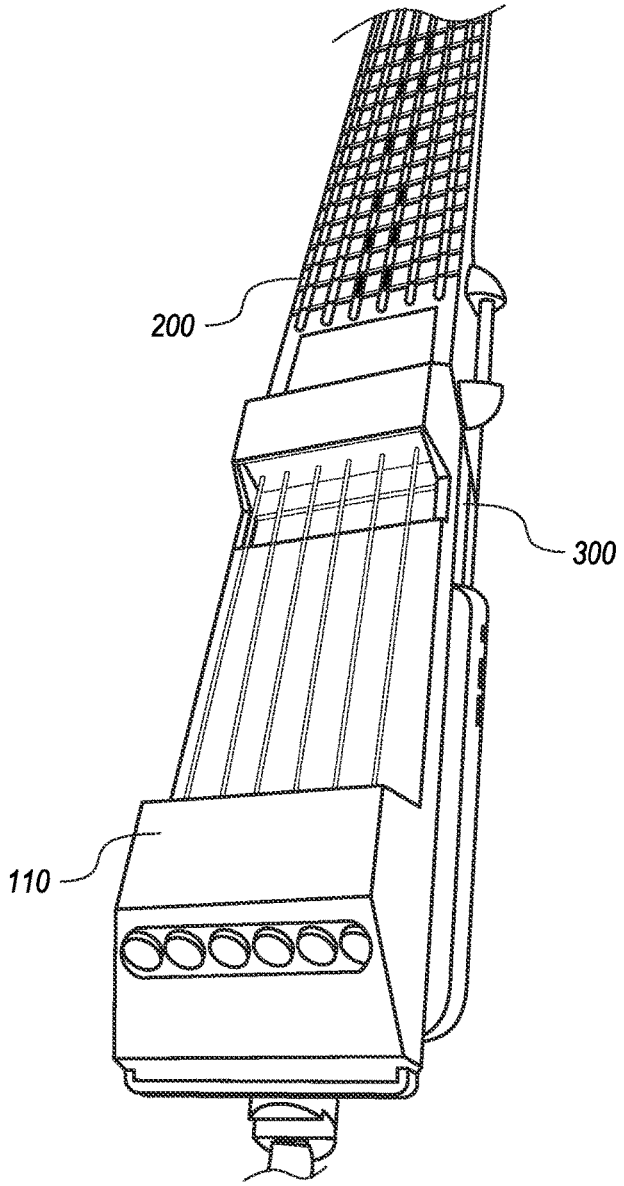
FIG. 27 shows a front perspective view of fingerboard 200 and dock 300 joined with string box 110 embodiment of the present invention.

With reference to FIG. 27, shown is a front perspective view of the fingerboard 200 and dock 300 included with the string box 110 embodiment of the present invention. As further shown, a data cable 333 is connected to the strong box 110 for communication with external data sources.

Figure 28:
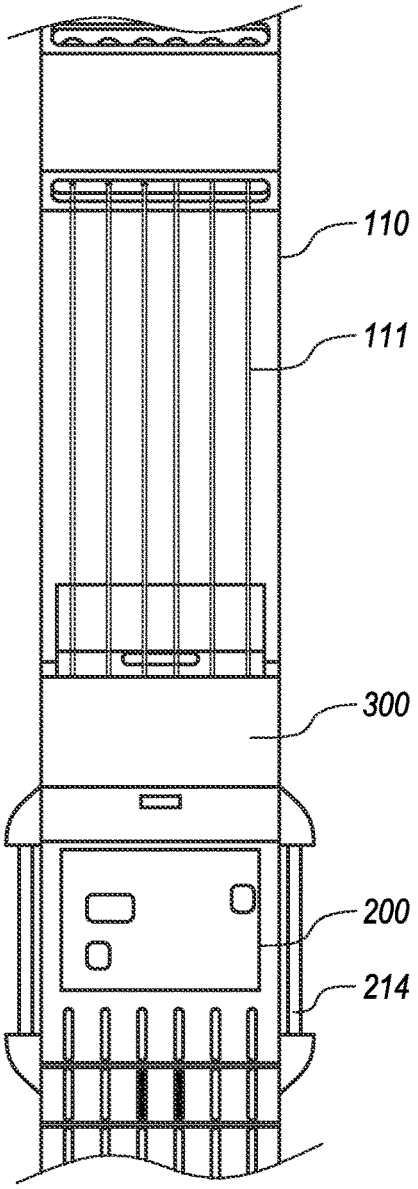
FIG. 28 shows a front plan view of a dock 300 joined with string box 110 embodiment of the present invention.

With reference to FIG. 28, shown is a front plan view of a string box 110 embodiment of the present invention included with the dock 300 and fingerboard 200.

Figure 29:
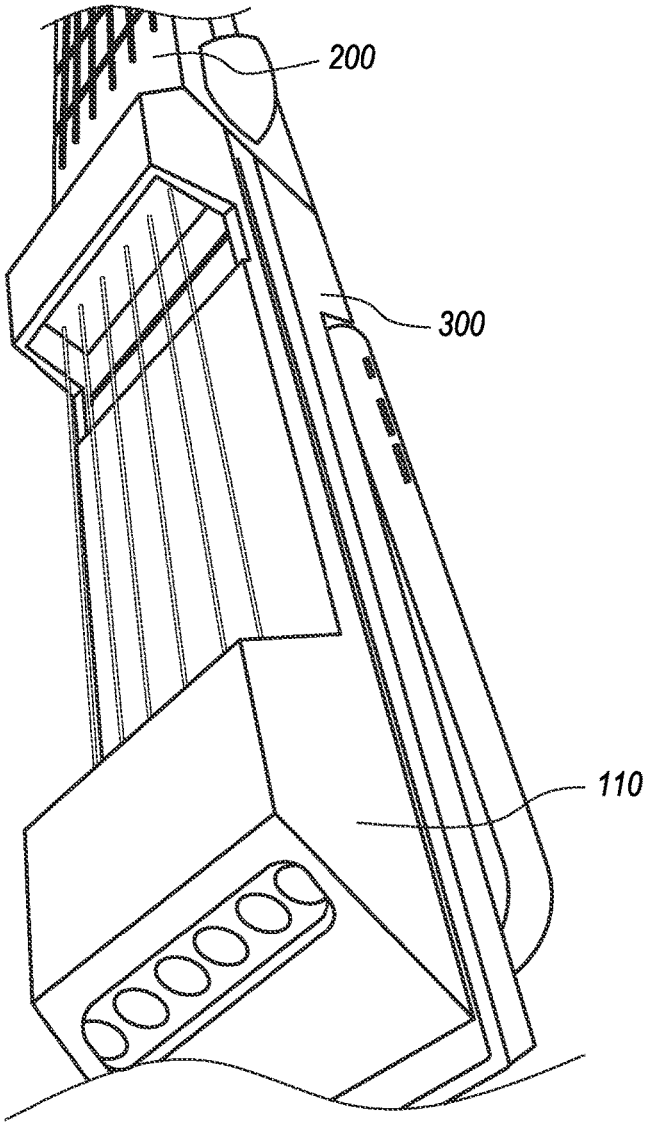
FIG. 29 also shows a front perspective view string box 110 embodiment of the present invention joined with dock 300 of the present invention.

With reference to FIG. 29, similar to FIG. 27, shown also is a front perspective view string box 110 embodiment of the present invention joined with dock 300 of the present invention.

Figure 30:
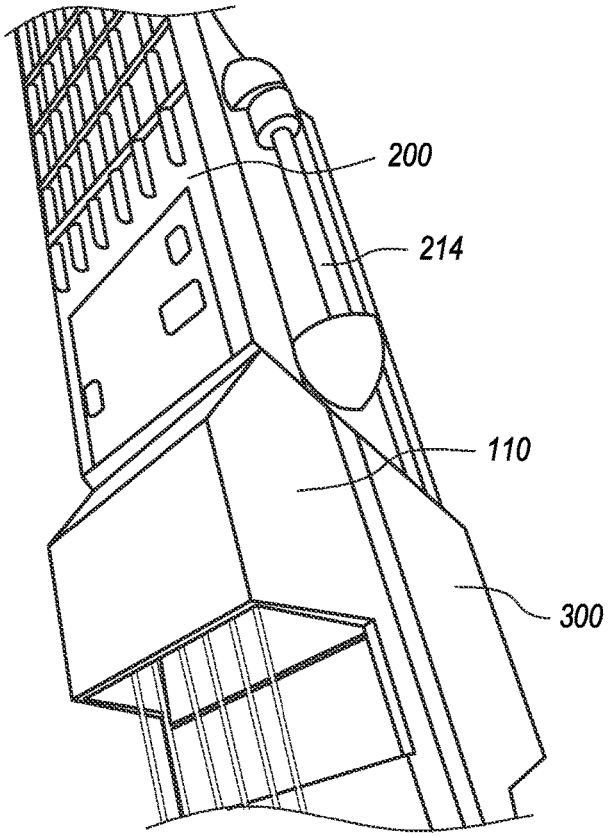
FIG. 30 shows a front perspective view of fingerboard 200 and dock 300 joined with string box 110 embodiment of the present invention.

With reference to FIG. 30, shown is a front perspective view of the fingerboard 200 and dock 300 included with the string box 110 embodiment of the present invention.

Figure 31:
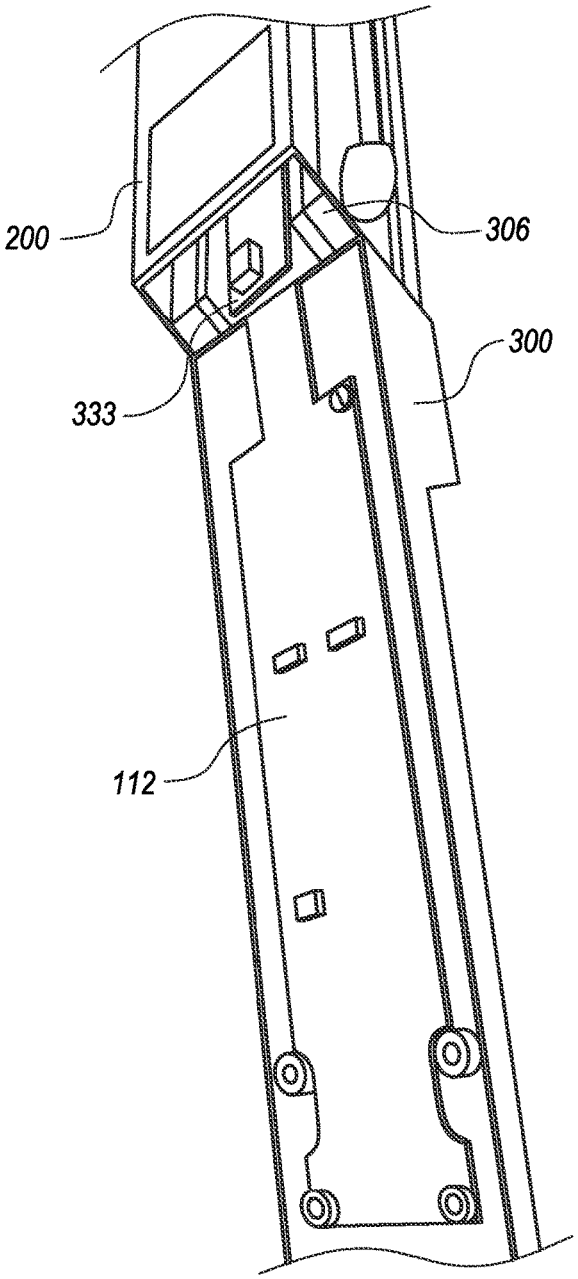
FIG. 31 shows a front perspective view of the circuit board 112 for string box embodiment of the present invention joined with the dock 300 of the present invention.

With reference to FIG. 31, shown is a front perspective view of the circuit board 112 for string box 110 embodiment of the present invention mounted on the dock 300 of the present invention, which is joined with the fingerboard 200. As shown, the circuit board 112 includes a data connection 333 connected to the HDMI data connector 334 of the fingerboard 200 main circuit board 201. The circuit board 112 includes capacitive sensing circuits and op amps for generating signals representative of each string 111. Preferably, the dock 300 of this string box 110 embodiment includes a battery supply, such as shown in FIG. 15.

With reference to FIG. 32, shown is a front perspective view of the fingerboard 200 and dock 300 with wireless tablet 101 inserted of the present invention as an additional alternative embodiment.

With reference to FIG. 33, shown is a rear perspective view of a dock 300 with wireless tablet 101 inserted of the present invention. As shown, the tablet includes a magnet or plate 302 or 303 that attracts to magnets 302 in the dock 300.

With reference to FIG. 34, shown is a rear perspective view of a dock 300 without wireless tablet 101 inserted of the present invention. As also shown, mounts 214 are included on the back of the fingerboard 200 for attachment to external devices, such as guitar straps.

With reference to FIG. 35, shown is a front perspective view of a dock 300 with hardware box controller 120 of the present invention. The box controller 120 is further comprised of at least a central processor, scanning multiplexer electronics, and at least one input/output ports 337 for serial interfaces (MIDI/USB/SPI/TTL/Wireless). In a preferred embodiment the input/output port is a USB port. In another preferred embodiment the input/output port 337 is a wireless radio.

The embedded electronics 210 merge serial fingerboard 200 data from the main CPU 212 with MIDI data generated by the knobs and other accessories 121 mounted in the box shell, or hardware box 120, thereby providing addition controls that might be found on a larger keyboard or guitar-like instrument and not provided by the fingerboard 200 alone.

As shown in FIG. 63, the dock 300 and/or fingerboard 200 on the one hand and the play device 100 on the other hand, use their corresponding user interfaces 1100 and 1101, processing 1000 and 1001 and communications 1200 and 1201 to communicate between their respective processors and software to generate, process, modify, play and otherwise control various sound, light and other data, instructions and information 109. For example, the user interfaces 1100 of a smart device, such as the display 102 and touch surface 107, and associated controls (e.g., tones, sounds, strings 111) 103, applications 104, menus/options (e.g., instruments, music) 106 are used for user interaction, including data output and collection. The processors and processing capability 1000 of the smart device are used to compute and process the applications 104 and data and instructions 109 exchanged between the user, applications and dock 300 and fingerboard 200 and other auxiliary units. The communication hardware and communications software 1100 and associated communication protocols of and used by the smart device communicate with corresponding processors 201, 205, 211, 212 of the dock and fingerboard 200/300. The user interfaces of the dock 300 and fingerboard 200, such as the keyboards, lights, keys, sensors (203, 204, 206-210. 213. 216) are used for user interaction, including data 109 output and collection. Their processors and software (305, 201, 202, 205, 211, 212, 108) compute and process data 109 between user, play device 100 and other auxiliary units.

As such, it is further contemplated that the present invention includes one or more software applications 104. As a primary example, an application called iTar App, may be used which may run on a phone, tablet or other smart device 101 mounted on the dock 300 and utilizing the touchscreen 107 and display 102 of the device 101 to simulate guitar strings 111 (and other instruments) which may be strummed to trigger the notes that are fingered on the attached fingerboard 200. As such, the circuitry 201 of the fingerboard 200 may communicate with the smart device 101, such as via Bluetooth MIDI data communicated by the blue tooth modulator 204 of the fingerboard 200 main circuit board 201 to the smart device 101, and the iTar App 104 provides a wide array of functionality. For example, the strumming motions are translated to create MIDI "velocity" values that affect the volume and other musical characteristics of the musical notes. The strings 111 (and controls 103, options 106 and other triggers) are also sensitive to position along their length such that touching in a different position will produce a different sound. In this way it is also possible to touch the trigger 111 to play a note and then slide the finger up and down the length of the trigger 111 to change the sound in various ways, such as "bending" the pitch for instance. The iTar App also displays 102 touch-sensitive areas called "pads" that may be tapped to trigger other sounds such as drums (e.g., see 106 in FIG. 54). There are also areas of the touch screen that display simulations of rotary potentiometers and slide-pots that are used by sliding the indicating pointer into a position where iTar 104 remains, setting a level on a musical parameter. The iTar App 1 0 4 may feature standard strumming and "picking" techniques or even new strumming techniques, i.e. one-pad triggering, single-key re-triggering, follow-on with a CC EFX, or trigger from the fingerboard 200 and use the smart device 101 for EFX only.

The iTar App 104 outputs USB-MIDI data that is the merged data stream from the fingerboard 200, data from the fingerboard 200 input that is modified by the iTar App 104, data from any external MIDI or other data port 337 connected to the iTar assembly, and any data issued by the iTar App 104 itself. The resultant USB-MIDI data stream is available to any other loaded music application 104 in the smart device 101 that can recognize a MIDI device. In an alternative embodiment, the MIDI stream from the iTar App 104 is output in a proprietary format that is recognized by music applications 104 that code their data input specifically for the iTar App 104. In either case the fingerboard 200 is then able to directly perform music using third-party music applications 104 such as synthesizers and other music creation tools. Tablature recorder software running in the iTar App 104 can also record the key presses from the fingerboard 200 for playback on the screen which can be used for educational or compositional purposes. Further, when the LED fingerboard 200 is installed, the tablature data may be fed back to the fingerboard 200 to light the LEDs according to the recorded performance, such as under control of the application 104 running on the play device 101 and in communication with the processors 212 and circuitry 201 of the fingerboard 200.

The iTar App 104 includes a user interface (see display 102 and touch surface 107 and controls 103 and menus 106 running on application 104 as shown in FIGS. 52 to 55) and provides various options for the user, such as picking a surface of the display to "play," including by example, strings, an xy pad, a 3d touch surface (like a drum surface) and any other surface option that could be programmed into the App 104. By further example, a user could pick the type of instrument, e.g., acoustic, steel, etc., and/or the type of sound, e.g., wind, percussion, etc. By further examples, the UI of iTar App provides for selection of tunings, controls for sequencers (e.g., select sequence, create sequence, record, replay, repeat, set BPM clock), sensors (e.g., low level, high level, modulated levels, setups levels) and various other settings such as controls for adjusting and animating the onboard LED lighting. Examples include: "Set Global Blue=50" or "Shift LEDs left; Repeat 4 times", or "Set MIDI User CC 16=25".

In addition, iTar App can be used with the present invention with other applications 104 in the background, such as other musical applications 104 like GarageBand, Sunrizer, etc., so the functionality is not limited to the options available via iTar App 104. The iTar App 104 can be used for making music by sending MIDI notes and other data to third-party iOS/Android music apps 104 running in the background on the smart device.

In still another embodiment of the present invention, there is provided a software application 104 for installation on the incorporated smart device wherein the software may simulate guitar strings 111 on the smart device 101 that may be activated through the touchscreen 107 of the device 101 and may communicate finger placement on the electronic guitar fingerboard 200 for teaching and/or entertainment purposes.

As illustrated in FIGS. 52 to 55, the phone device (or tablet or other smart device) may use and run such software applications 104, e.g., iTar App to allow the user to see and use via the display simulated guitar strings 111 or other instruments (e.g., drum pads, horns, keyboards, other string instruments) which may be strummed or otherwise activated to trigger the notes that are fingered on the attached fingerboard 200 via a touch sensitive screen 102, 107. Such applications 104 may run by themselves, e.g., iTar App includes its own synthesizer capabilities, or with other applications in the background. The circuitry 305, 201 of the dock 300 and fingerboard 200 may also operate independent of an application 104, and may embody stand-alone synthesizer software and programming. Selectable features such as sound/patch selection, modulation, and audio effects may also be controlled by MIDI commands from an external source.

Figure 52:
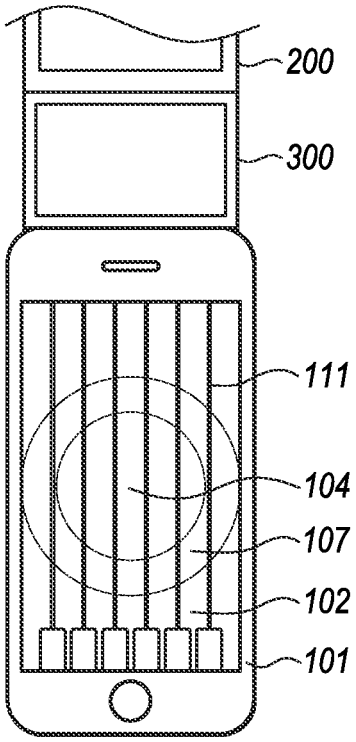
FIG. 52 shows a front plan view of the display 102 of the wireless phone 101 showing an application 104 of the present invention, wherein the display 102 shows strings 111 for playing the present invention.
Figure 53:
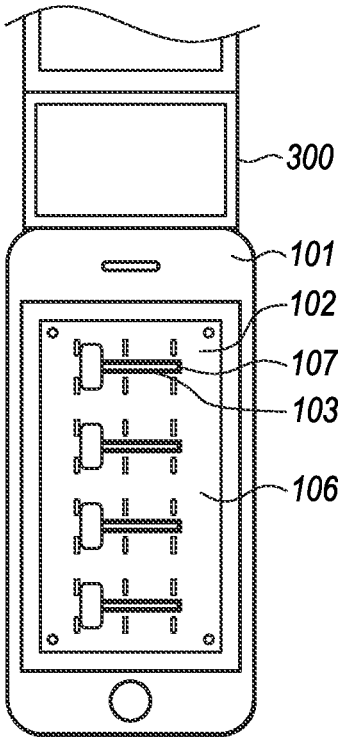
FIG. 53 shows a front plan view of the display 102 of the wireless phone 101 showing an application 104 of the present invention, wherein the display 102 shows controls 103 for adjusting tone and other sound features of the present invention.
Figure 54:
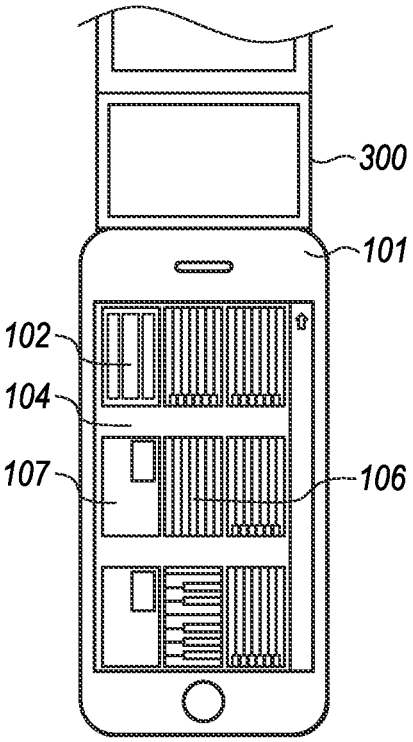
FIG. 54 shows a front plan view of the display 102 of the wireless phone 101 showing an application 104 of the present invention, wherein the display 102 shows a menu 106 of selectable instrumentation for the present invention.
Figure 55:
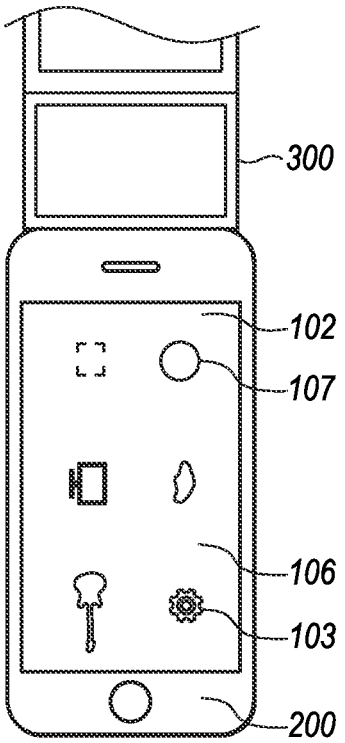
FIG. 55 shows a front plan view of the display 102 of the wireless phone 101 showing an application 104 of the present invention, wherein the display 102 shows a menu 106 of setting options of the present invention.
Figure 56:
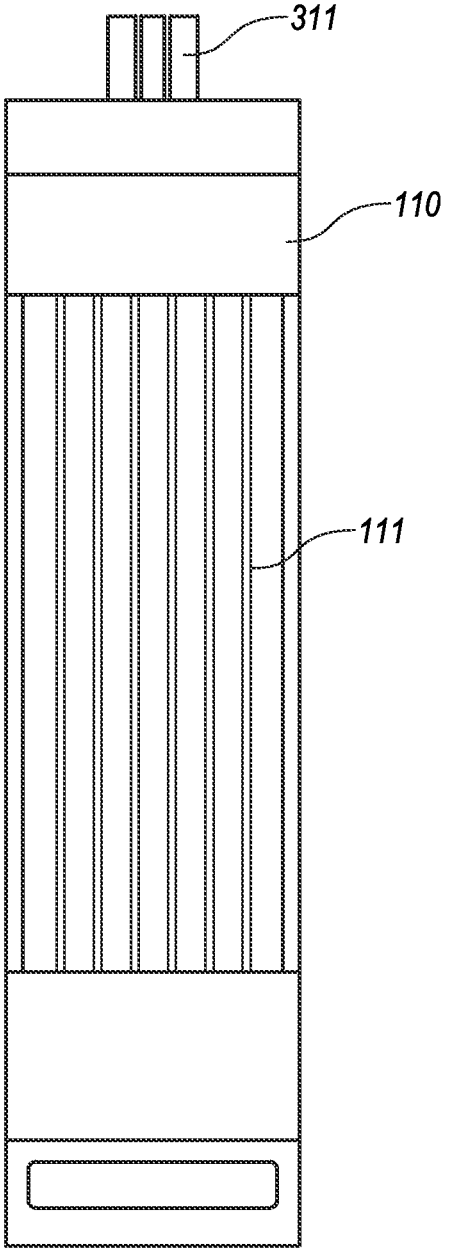
FIG. 56 shows front plan view of an embodiment of the string box 110 of the present invention.
Figure 57:
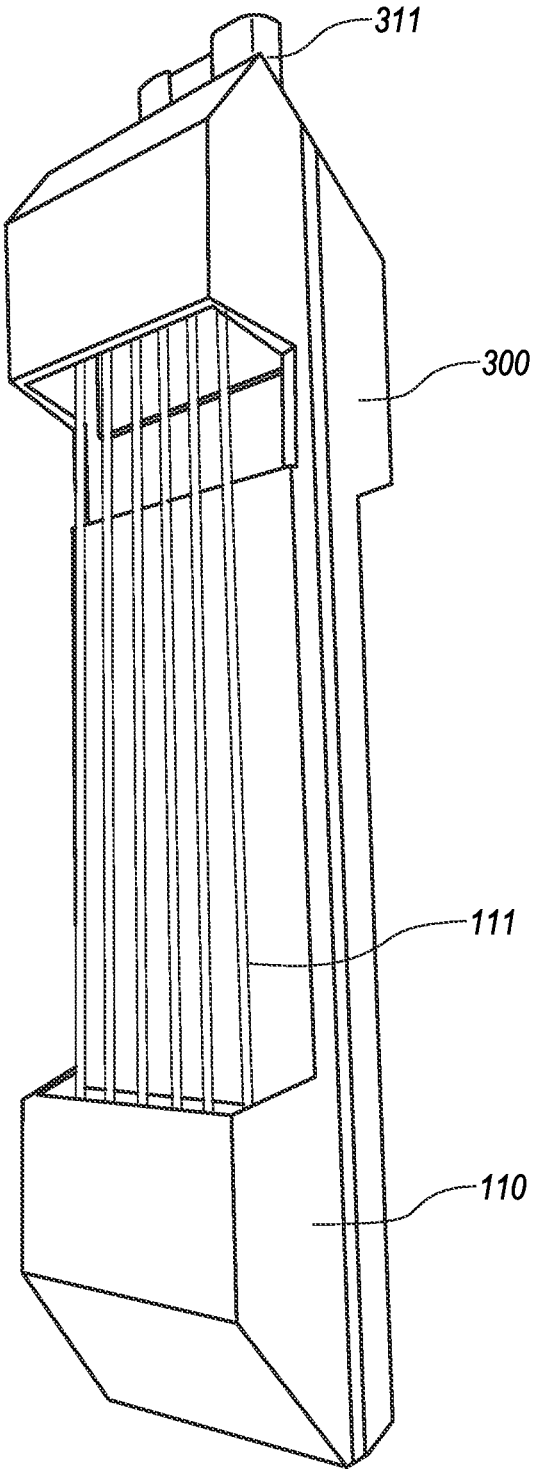
FIG. 57 shows side perspective view of such string box 110 of the present invention.
Figure 58:
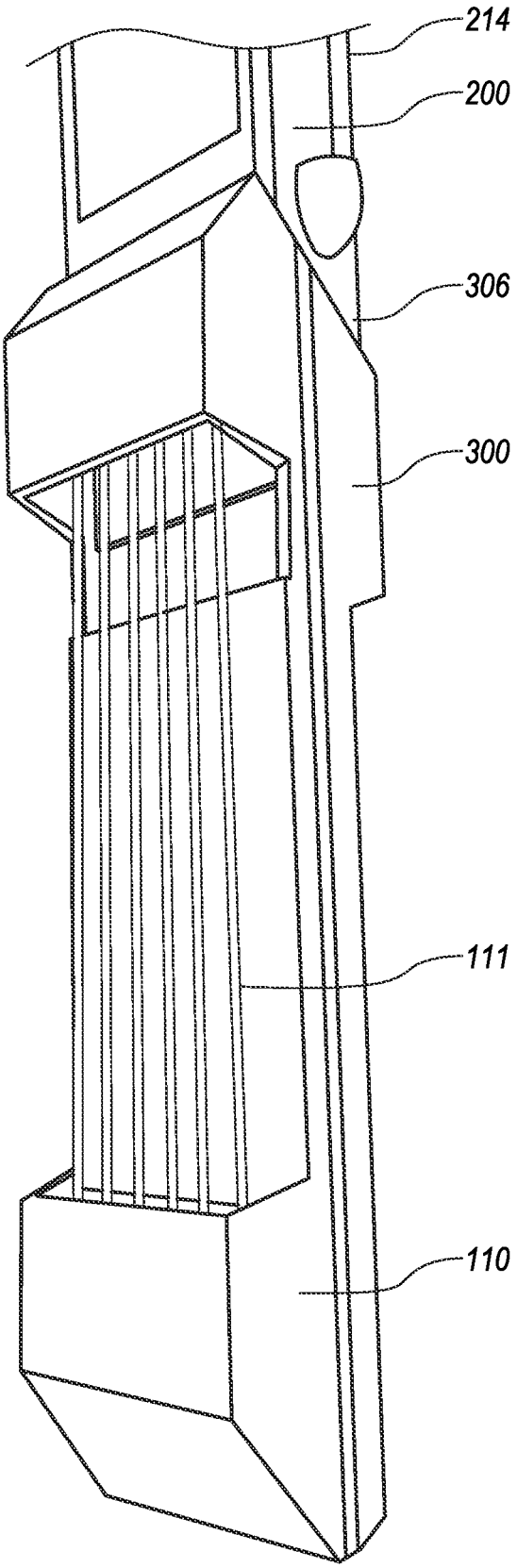
FIG. 58 shows side perspective view of a dock 300 with a string box 110 inserted in the fingerboard 200 of the present invention.
Figure 59:
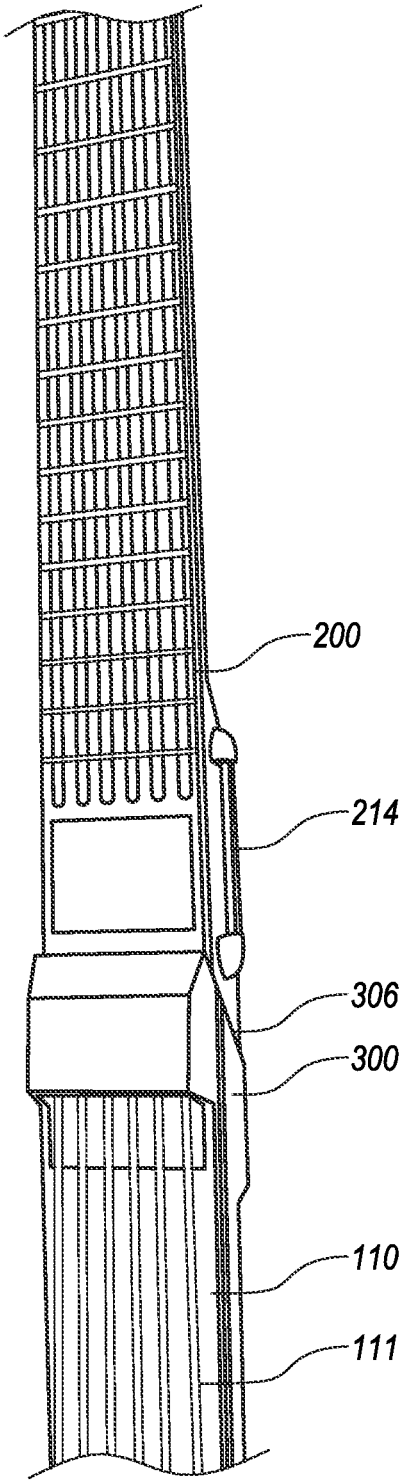
FIG. 59 shows front plan view of a dock 300 with a string box 110 inserted in the fingerboard 200 of the present invention.

As illustrated in FIG. 52, the application may have a home page, including by example a display of guitar strings as described above. The application 104 may provide numerous other features, such as features selectable from a menu 106 accessible via the home page, with subsequent pages and menus to select various controls and other features 103. Such features may include a variety of functions available via various software components and familiar to musicians and music producers. Exemplary features include: sound modification, such as distort, delay, reverb and tone; muting of strings; sequencer functions, such as selecting metronome pace; recording music and sequences of notes played; providing music for users to read such as tabs and note sequences.

In conjunction with such applications 104, the display of the phone device 100 (other smart device) may display various views, including x-y views, mode wheels, pitch pins, continuous controllers (e.g., movement of finger across the display translates to change in sounds, pitch, tone, synthetization, lighting response on the fingerboard 200). Preferably, the smart device display 102 and LED display 204 and fingerboard 200 use bit color pixels (e.g., 15-bit color for LEDs) and can load and color maps in conjunction with the application 104, and these color sequences can also be transmitted to the fingerboard 200 and associated LED lights 204, 209 (including for example patterns, words, scrolling patterns and words, bit-mapped images, sequences). Such devices 101 and fingerboard 200 may also use MIDI velocity (e.g., velocity, channel, pitch, note bytes) to communicate with the LED lights 216 based on a variety of actual and programmable triggers, such as note and pitch. In this regard, a command language has been built into the iTar 104 LED lighting OS that uses MIDI Notes, MIDI note velocity, MIDI Continuous Control commands, and MIDI Sysex to provide a range of lighting effects that can be accessed locally from the fingerboard 200 or the iTar app 104, or remotely from another data stream delivered via USB or wirelessly.

Users can develop their own screens 103, 106 for the applications 104, such as if the applications and associated software are open sourced.

While the particular Electronic Musical Instrument With Device as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

The invention claimed is:

1. A system for playing sounds and lights, the system comprising:

a play device comprising a display and touch screen, processor and communication hardware and software that receives, transmits and processes sound and light information and communicates with other processors and communication hardware and software;

a dock comprising a body removably attached to said play device, a power source, power connectors and data connectors;

a fingerboard comprising a body removably attached to said dock via a joinder mechanism, a keyboard with keys, lights and a processor and communication hardware and software that receives, transmits and processes sound and light information and communicates with other processors and communication hardware and software;

the play device and fingerboard are in communication with each other via their respective processor and communication hardware;

wherein the play device exchanges sound and light information partially in response to engagement of said keys of the fingerboard and directs the display of said lights of the fingerboard and play of sounds, wherein mounts are included on the back of the fingerboard for attachment of external devices.

2. The system of claim 1, wherein a plurality of magnets are included in openings in the body of the dock and a magnetic plate removably attached to the play device physically couple the dock and the play device.

3. The system of claim 2, wherein the magnets are sufficiently deep in the openings such that the magnets do not touch the magnetic plate when the play device is coupled to the dock.

4. The system of claim 1, wherein the processor further includes an input/output port selected from the group consisting of MIDI, USB, SPI, TTL and wireless.

5. The system of claim 4, wherein the input/output port is a USB port.

6. The system of claim 4, wherein the input/output port is a wireless radio.

7. The system of claim 1, wherein the fingerboard is further comprised of embedded software capable of controlling LED lights under the keys wherein the lights illuminate based on instruction for fingerboard placement.

8. The system of claim 1, wherein the fingerboard is further comprised of embedded software capable of LED lights under the keys which illuminate in response to touch.

9. The system of claim 8, wherein the LED lights are programmed and controllable through software operating on the playing device.

10. A system for playing sounds and lights, the system comprising:

a play device comprising a display and touch screen, processor and communication hardware and software that receives, transmits and processes sound and light information and communicates with other processors and communication hardware and software;

a dock comprising a body removably attached to said play device, a power source, power connectors and data connectors;

a fingerboard comprising a body having a keyboard with keys, lights and a processor and communication hardware and software that receives, transmits and processes sound and light information and communicates with other processors and communication hardware and software;

the play device and fingerboard are in communication with each other via their respective processor and communication hardware;

wherein the play device exchanges sound and light information partially in response to engagement of said keys of the fingerboard and directs the display of said lights of the fingerboard and play of sounds, wherein the attachment of the play device to the dock is accomplished with deepened recesses in the dock and magnets on a plate which are received in the recesses.

11. The system of claim 10, wherein magnets provide joinder and connection energy and means in a z direction perpendicular to the surface of the dock and plate and the joinder of the magnets on the plate in the recesses of the dock provide connection in x and y directions parallel to the surface of the dock and plate.

12. The system of claim 10, wherein mounts are included on the back of the fingerboard for attachment of external devices.

13. The system of claim 10, wherein the processor further includes an input/output port selected from the group consisting of MIDI, USB, SPI, TTL and wireless.

14. The system of claim 13, wherein the input/output port is a USB port.

15. The system of claim 13, wherein the input/output port is a wireless radio.

16. The system of claim 10, wherein the fingerboard is further comprised of embedded software capable of controlling LED lights under the keys wherein the lights illuminate based on instruction for fingerboard placement.

17. A system for playing sounds and lights, the system comprising:

a playing device comprising a display and touch screen, processor and communication hardware and software that receives, transmits and processes sound and light information and communicates with other processors and communication hardware and software;

a dock comprising a body removably attached to said play device, a power source, power connectors and data connectors wherein a plurality of magnets are included in openings in the body of the dock and a magnetic plate removably attached to the play device physically couple the dock and the play device;

a fingerboard comprising a body removably attached to said dock via a joinder mechanism, a keyboard with keys, lights and a processor and communication hardware and software that receives, transmits and processes sound and light information hardware and software;

the play device and fingerboard are in communication with each other via their respective processor and communication hardware;

wherein the play device exchanges sound and light information with the fingerboard based upon engagement of said keys of the fingerboard, directs the light displayed on said lights of the fingerboard and plays resulting sounds while the fingerboard displays resulting lights.

18. The system of claim 17, wherein mounts are included on the back of the fingerboard for attachment of external devices.

19. The system of claim 17, wherein the dock is further comprised of a box controller.

20. The system of claim 19, wherein the box controller is further comprised of a central processor, scanning multiplexer electronics, and at least one input/output port for serial interferences.

21. The system of claim 20, wherein the input/output port is selected from the group consisting of MIDI, USB, SPI, TTL and wireless.

22. The system of claim 21, wherein the input/output port is a USB port.

23. The system of claim 21, wherein the input/output port is a wireless radio.

24. The system of claim 19, wherein the box controller is further comprised of a plurality of ports for knobs, pads, sliders, whammy, strumming triggers, accelerators and/or joysticks for manipulating the sound output of the system.

25. The system of claim 24, wherein the electronics merge fingerboard data from the main CPU with the MIDI data generated from the controller box thereby providing a plurality of controls comparable to a full size instrument.

26. The system of claim 17, wherein the fingerboard is further comprised of embedded software capable of controlling LED lights under the keys wherein the lights illuminate based on instruction for finger placement.

27. The system of claim 17, wherein the fingerboard is further comprised of embedded software capable of controlling LED lights under the keys which illuminate in response to touch.

28. The system of claim 26, wherein the LED lights are programmed and controllable through software operating on the playing device.

29. The system of claim 27, wherein the LED lights are programmed and controllable through software operating on the playing device.

* * * * *